US006007761A

United States Patent [19]

Nakagawa et al.

[11] Patent Number: 6,007,761

[45] Date of Patent: Dec. 28, 1999

[54] HEAT TREATING FURNACE FOR A CONTINOUSLY SUPPLIED METAL STRIP

[75] Inventors: Tsuguhiko Nakagawa; Kenta Karube; Hiroshi Okamoto; Toshiyuki Iwatani; Sakae Mochizuki; Yoshiharu Fujiwara, all of Kurashiki, Japan

[73] Assignee: Kawasaki Steel Corporation, Kobe, Japan

[21] Appl. No.: 09/016,363

[22] Filed: Jan. 30, 1998

[30] Foreign Application Priority Data

Jan. 31, 1997 [JP] Japan ..... 9-018456
Jan. 31, 1997 [JP] Japan ..... 9-018457

[51] Int. Cl.[6] ..... C21B 7/22; C21D 9/52

[52] U.S. Cl. ..... 266/103; 266/155; 266/156

[58] Field of Search ..... 266/102, 103, 266/155, 156

[56] References Cited

U.S. PATENT DOCUMENTS 4,239,483 12/1980 Iida et al. .

FOREIGN PATENT DOCUMENTS 0 181 830 5/1986 European Pat. Off. .
0 750 170 A1 12/1996 European Pat. Off. .
55-131129 11/1980 Japan .
61-117227 6/1986 Japan .
62-86126 4/1987 Japan .
6-257724 9/1994 Japan .
6-257738 9/1994 Japan .
6-288519 10/1994 Japan .
9-087750 3/1997 Japan .

OTHER PUBLICATIONS

Japanese Patent Abstract JP357143444A, Akira et al. Sep. 1982.
Japanese Patent Abstract JP357143442A, Masato et al. Sep. 1982.
European Patent Abstract EP000856588A2, Tsughiko et al. Aug. 1998.

*Primary Examiner*—Scott Kastler
*Attorney, Agent, or Firm*—Oliff & Berridge, PLC

[57] ABSTRACT

A continuous heat treating furnace in which heat is efficiently recovered from the combustion exhaust gas from the heating section of a continuous annealing furnace. The continuous annealing furnace of the metal strip is a heating furnace or a heating device provided with plural burners for heating to a predetermined temperature a steel material or a continuously supplied metal strip by means of combustion of the burners; a regenerative heat exchanger for collecting a sensible heat of a combustion exhaust gas of the burners, reserving the heat in a regenerator and supplying a predetermined gas to the regenerator to recover the heat to the predetermined gas; and a preheating section for blowing the predetermined gas from the regenerative heat exchanger to the metal strip for preheating. The heat exchanger body is divided into at least three sections, each section having a regenerator. When the heat exchanger body is continuously or intermittently rotated, each section is provided with a path for successively repeating to pass a heating section combustion exhaust gas for applying a sensible heat of exhaust gas to the regenerator, a purging gas for removing debris sticking to the regenerator when applying the sensible heat of the heating section exhaust gas and a circulating gas for collecting the sensible heat of the regenerator and blowing the heat to the metal strip passing the preheating section to raise a temperature of the metal strip.

21 Claims, 17 Drawing Sheets

Fig.9 PRIORART

HEAT TREATING FURNACE FOR A CONTINOUSLY SUPPLIED METAL STRIP

BACKGROUND OF THE INVENTION

1. Field of Invention

The present invention relates to a continuous heat treating furnace for a metal strip such as a continuous annealing furnace for annealing a continuously supplied steel strip or the like, and especially to a continuous heat treating furnace for a metal strip. The furnace is provided with a preheating section for preheating the metal strip to some temperature on an incoming side, and a heating section for treating the metal strip at a higher temperature.

In the annealing furnace exchanger for use in the invention, which anneals the metal strip, the temperature of the circulating gas to be blown over the surface of the metal strip in the preheating section is efficiently raised by re-circulating the heated exhaust gas from the preheating section.

2. Description of Related Art

A conventional continuous annealing furnace for continuously annealing a strip or a metal-strip continuous heat treating furnace is known wherein the furnace structure has a heating section for heating a metal strip to its transformation temperature $A_2$ or higher. This heating device, constituted of multiple radiant tubes, is disposed around the continuously supplied strip. As the metal strip is supplied, if the necessary heat treating process is the annealing in a finishing process, the metal strip must be prevented from oxidizing. Since the heating temperature is high, oxygen components including $CO_2$ and $H_2O$ in the atmosphere of the furnace promote oxidization of the strip. Therefore, the annealing atmosphere of the strip needs to be at least a non-oxidizing atmosphere or a reduction atmosphere. In a burner which generates combustion exhaust gas including $CO_2$ or $H_2O$, the in-furnace or atmospheric temperature cannot be directly raised.

To solve this problem, a high-temperature combustion exhaust gas or accordingly heated gas is supplied from the burner to the radiant tubes. Then, the strip can be heated with the radiant heat from outer walls of the radiant tubes. Consequently, by maintaining the in-furnace atmosphere as the non-oxidizing atmosphere or the reduction atmosphere, oxidization of the strip can be avoided as well as efficient heating of the supplied strip.

In a conventional continuous annealing furnace for annealing a metal strip or the like, by passing the heating-section exhaust gas or another combustion exhaust gas through the heat exchanger, heat is applied to the circulated gas. By blowing the gas over the metal strip passing through the preheating section, the temperature of the metal strip is raised.

Additional information pertaining to convective heat exchangers for recovering heat via tubes and regenerative burners is disclosed in Japanese published patent application 4-80969. A regenerative radiant tube burner is disclosed in Japanese laid open patent applications 6-257738 and 6-257724.

The foregoing related arts have problems. In an actual continuous annealing operation, to improve the production efficiency, the strip supply speed (plate passing speed) has a lower limitation. To improve equipment efficiency, the size of the heating section through which the strip passes should be as short as possible. To satisfy such a requirement, the in-furnace or radiant-tube temperature has to be set relatively higher than the desired ultimate strip temperature. Specifically, by raising the radiant-tube temperature, thereby increasing the difference between the in-furnace temperature and the strip temperature, the strip can be quickly heated to a predetermined higher temperature. However, by raising the radiant-tube temperature above the desired strip temperature, the radiant-tubes are subjected to additional thermal load and subsequent breakdown.

Specifically, thermal stress and high-temperature creep cause the radiant tubes to break. Their high-temperature life is deteriorated, and when the temperature of the radiant tubes is raised, the fuel consumption rate is increased, thereby disadvantageously increasing cost as well.

In the above first example, the high-temperature life of the radiant-tubes is shortened by several years. In the latter, the fuel consumption rate is directly reflected in increased cost. Therefore, economic constraints have focused improvements on decreasing the fuel consumption rate.

In an attempt to solve this problem, the combustion efficiency of the burner for heating the radiant tubes is raised. A sensible heat of combustion exhaust gas resulting from heating of the radiant tubes is recovered by a convective heat exchanger to a sensible heat of combustion air. Specifically, by increasing the temperature of the combustion air supplied to the burner, the combustion efficiency in the burner is enhanced.

Realizing the above solution, the operation line is provided with a preheating section for preheating the strip. In the preheating section, the sensible heat of the combustion exhaust gas from the burner is recovered as the sensible heat of a predetermined gas by a convective heat exchanger in the same manner as aforementioned. By blowing the heated gas directly onto the strip in the preheating section, the temperature of the strip can be directly increased.

However, in the aforementioned convective heat exchanger, combustion air, steam or another gas is passed through the tubes. Surrounding the tubes is the combustion exhaust gas. Therefore, via the tubes a sensible heat of the combustion exhaust gas is transmitted to the combustion air, steam or another gas for recovery. Hence, not only a sufficient difference in temperature between the combustion exhaust gas and the recovery gas must exist, but a large heat transmission area is also required. Even though large heat exchangers are available for recovering a sufficient amount of heat from the combustion exhaust gas, the installation space for these large exchangers is not available. Therefore, the heat recovery ratio is low.

Even if a sufficiently large heat transmission area is secured, it is difficult to heat the gas in the tubes in such a short time to a sufficiently high temperature. Thus, whether the combustion efficiency of the burner is enhanced with the convective heat exchanger, or the strip is preheated in the preheating section, the fuel consumption rate or the high-temperature life of the radiant tubes cannot be enhanced as expected.

To solve these problems, Japanese laid-open patent application 6-288519 discloses a continuous heat treating furnace in which continuous annealing is performed by using a regenerative burner device. In this reference, the regenerative burner device comprises of a pair of burners. One burner performs combustion, and a sensible heat of combustion exhaust gas is stored in the regenerator of the other regenerative burner. For example, when the temperature of the regenerator of the other regenerative burner reaches an upper-limit temperature and the combustion-heat reserve cycle reaches its limit, then that burner stops combustion, while the other regenerative burner performs combustion. Specifically, combustion air is passed through the regenerator of the other regenerative burner for combustion. In this case, the sensible heat of the combustion exhaust gas can be efficiently recovered as can that of the combustion air. Therefore, when the regenerative burner device is used as a burner in the continuous annealing furnace or another continuous heat treating furnace, the heat recovery efficiency can be enhanced. This hereby provides the expected reduction in fuel consumption.

In the regenerative burner device, each combustion burner needs to have a regenerator, which complicates the structure and increases the size of the device. In actual operation, however, the standard continuous annealing furnace or continuous heat treating furnace is provided with up to a hundred burners or heaters, while a larger furnace may contain hundreds of burners or heaters. If the burners or the heaters are replaced with regenerative heaters or burners, the structure is greatly complicated and enlarged. Not to mention the fact that it would be impossible to replace all the burners with regenerative burners or heaters because of the already restricted space. Additionally, control would become very laborious, which would disadvantageously complicate both maintenance and repair. Finally, it would be economically inferior to modify the existing equipment by replacing the usual burners with the regenerative heaters or burners.

SUMMARY OF THE INVENTION

The present invention has been developed with these problems in mind. This invention provides a continuous heat treating furnace for a metal strip which recovers the sensible heat of combustion exhaust gas from a burner in the heating section with a high degree of efficiency. The recovered sensible heat is returned to the predetermined gas and the preheating section blows the gas steadily over the metal strip to increase the temperature of the metal strip supplied to the heating section. As a result, the temperature increase in the heating section is not as great, so the temperature requirement in the furnace can be lowered. Hence, the radiant tubes are kept at a lower temperature, thereby reducing fuel consumption while extending the high-temperature life of the radiant tubes. Further, the blowing of the gas over the metal strip in the preheating section is stabilized, while at the same time the combustion exhaust gas and the blowing gas can be efficiently used.

To attain this effect with the greatest efficiency, this invention provides an inventive heat exchanger which efficiently recovers the sensible heat of combustion exhaust gas from the heating section of a metal-strip annealing furnace which uses multiple burners (including a direct heating furnace or the like) and which can apply the recovered heat to the metal strip as it passes the preheating section of the annealing furnace.

Thus, in a first embodiment of the invention, there is provided a metal strip continuous heat treating furnace which comprises a heating furnace or a heater provided with plural burners for heating a steel material or a continuously supplied metal strip to a predetermined temperature by means of combustion of the burners; a regenerative heat exchanger device for collecting and storing the sensible heat of combustion exhaust gas from the burners in a regenerator and supplying a predetermined gas to the regenerator to recover the sensible heat and transfer it to the predetermined gas; and a preheating section for blowing the predetermined gas from the regenerative heat exchanger device to the metal strip.

The invention further includes a continuous metal strip heat treating furnace which comprises a heating section, provided with a plurality of radiant tubes, to which a combustion exhaust gas is supplied from the burners for heating a continuously supplied metal strip to a predetermined high temperature. The regenerative heat exchanger collects and stores in a regenerator the sensible heat of the combustion exhaust gas from the burners of the heating section, and supplies a predetermined gas to the regenerator to recover the sensible heat of the gas. The preheating section blows the gas from the regenerative heat exchanger to the metal strip on the incoming side of the heating section to accomplish preheating.

The sensible heat of the combustion exhaust gas, which is supplied and exhausted from the burners to the radiant tubes in the heating section, is collected and stored in the regenerator of the large-sized regenerative heat exchanger. By supplying air or another predetermined gas to the regenerator, the sensible heat of the combustion exhaust gas is collected and recovered to the sensible heat of the predetermined gas. By blowing the gas to the metal strip or the like in the preheating section, the metal strip is preheated. As opposed to the convective heat exchanger, the regenerative heat exchanger is remarkably superior in heat recovery efficiency. Therefore, when passing the regenerator, the predetermined gas gains an increased sensible heat, i.e. a higher temperature. Therefore, by blowing the high-temperature gas directly to the metal strip, the temperature of the metal strip is largely increased compared to the related art heat exchanges. Therefore, the increase in temperature of the metal strip required in the subsequent heating section is reduced. Because of this reduction, the in-furnace temperature, and subsequently the temperature required for the radiant tubes, may be lowered. In the aforementioned range of high temperatures, the rupture resistance of the radiant tube is determined by an index function of an inverse number of the temperature. It is also known that the rupture resistance is increased twice, to several times at only ten or more degrees centigrade. Therefore, the high-temperature life of the radiant tubes can be largely enhanced, while the fuel consumption rate of fuel gas or the like supplied to the burners can be decreased.

In the first embodiment of the invention, the process of recovering and using the sensible heat of combustion exhaust gas from the burners can be applied not only to the metal strip continuous heat treating furnace which uses the radiant tubes, but also to a furnace which uses direct heating burners.

In the metal strip continuous heat treating furnace according to a second embodiment of the invention, the regenerative heat exchanger device is formed of at least three regenerative heat exchangers which are provided with valves for switching the combustion exhaust gas and the to-be-supplied predetermined gas to the regenerator. A control means is provided for sequentially opening or closing the valves of the regenerative heat exchangers in such a manner that the predetermined gas with the sensible heat recovered in the regenerator is blown from at least one of the regenerative heat exchangers to the metal strip, while the other regenerative heat exchangers store in the regenerator the sensible heat of the combustion exhaust gas.

In the invention, three or more regenerative heat exchangers are used. From at least one regenerative heat exchanger, the sensible heat of the combustion exhaust gas stored in the regenerator is recovered as the sensible heat of the predetermined gas. The predetermined gas is blown to the metal strip in the preheating section. The sensible heat of the combustion exhaust gas is stored in the regenerator of the other regenerative heat exchangers. To operate the heat exchangers in this manner, the control valves are sequentially opened or closed. In the related art, only two regenerative heat exchangers are used. In this case, either one of the regenerative heat exchangers is heating the predetermined gas and blowing it to the metal strip, while the other regenerative heat exchanger is reserving in the regenerator the sensible heat of the combustion exhaust gas. This operation cannot be switched to another sequence in which the regenerative heat exchanger, which has blown the gas, stores the heat in the regenerator while the regenerative heat exchanger, which has stored the heat, blows the predetermined gas, due to the responsivity of the valves for supplying or exhausting the gas. Therefore, if the switching is performed, a time will arise during which the combustion exhaust gas is blown to the metal strip or neither gas can be blown to the metal strip. Blowing the combustion exhaust gas to the metal strip must be absolutely avoided to prevent contamination of the operating environment. On the other hand, the time during which neither gas is blown to the metal strip, a variation in temperature occurs in the direction in which the metal strip is supplied, another problem which must also be avoided.

To maintain the condition in which the high-temperature predetermined gas is continually blown to the metal strip, at least three regenerative heat exchangers are essential. By appropriately switching and controlling the control valves with the control means, at least one regenerative heat exchanger can continue blowing the high-temperature predetermined gas to the metal strip, while the other regenerative heat exchangers can efficiently store the sensible heat of combustion exhaust gas in the regenerator.

In the metal strip continuous heat treating furnace according to a third embodiment of the invention, each of the regenerative heat exchangers is provided with a valve for supplying the combustion exhaust gas to the regenerator, a valve for supplying the predetermined gas to the regenerator, a valve for exhausting the combustion exhaust gas from the regenerator to the outside of the preheating section, a valve for supplying the predetermined gas from the regenerator into the preheating section and a valve branched from the above system for supplying the predetermined gas from the regenerator into the preheating section to purge the heat exchanger. After the control means closes the valve for supplying the combustion exhaust gas to the regenerator of the regenerative heat exchanger, the valve for purging the heat exchanger with the predetermined gas is opened. While the valve for purging the heat exchanger with the predetermined gas is open, the valve for exhausting the combustion exhaust gas is opened and the valve for supplying the predetermined gas is closed. After closing the valve for purging the heat exchanger with the predetermined gas, the valve for exhausting the combustion exhaust gas is closed. Subsequently, the valve for supplying the predetermined gas is opened, then the valve for supplying the predetermined gas to the regenerator of the heat exchanger is opened.

In the invention, when either one of the three or more regenerative heat exchangers switches between the heat storing and gas blowing, the supply of the combustion exhaust gas to the regenerator is stopped by closing the relevant valve. Subsequently, the supply of the predetermined gas to the regenerator is started by opening the relevant valve. During this operation, the regenerator is filled with the combustion exhaust gas. In this condition, if the valve for supplying the predetermined gas is opened, the combustion exhaust gas will be blown onto the metal strip. Therefore, before the valve for supplying the predetermined gas to the regenerator is opened, another process for purging the regenerative heat exchanger with the predetermined gas is necessary. For this process, the relevant valve structure and a control for opening or closing the valve is necessary.

Specifically, while the valve for purging the predetermined gas is open, by opening the valve for exhausting the combustion exhaust gas, the combustion exhaust gas is exhausted from the regenerative heat exchanger. The regenerative heat exchanger is purged with the predetermined gas. Thereafter, the valve for purging the predetermined gas is closed, then the valve for exhausting the combustion exhaust gas is closed. Subsequently, by opening the valve for supplying the predetermined gas to the metal strip in the preheating section, the high temperature predetermined gas can be securely evacuated.

Also, according to a fourth embodiment of the invention, in the metal strip continuous heat treating furnace, the flow rate of the system provided in each regenerative heat exchanger, for purging the heat exchanger with the predetermined gas, is set less than the flow rate of the system for supplying the predetermined gas into the preheating section.

The valve for purging the predetermined gas and the valve for supplying the predetermined gas into the preheating section pass the same gas, and can therefore be formed into one. In the invention however, during the process of opening and closing the valves, if the valve for exhausting the predetermined gas into the preheating section for purging is opened, the valve for exhausting the combustion exhaust gas is opened. To facilitate this, a suction fan is usually disposed in the piping system for exhausting the combustion exhaust gas. In this case, the high-temperature predetermined gas to be exhausted from the regenerative heat exchanger to the preheating section will be exhausted from the regenerative heat exchanger to be purged via the valve for exhausting the combustion exhaust gas to the outside. To solve this problem, by setting the flow rate of the system for purging the predetermined gas less than the flow rate of the system for exhausting the predetermined gas into the preheating section, the high temperature predetermined gas is continually supplied from the regenerative heat exchanger into the preheating section. With a portion of the predetermined gas, the inside of the regenerative heat exchanger in the vicinity of the regenerator to be purged can be purged. Further, the flow rate of the system for purging the heat exchanger can be controlled by making the supply pipe diameter small, and interposing a throttle damper halfway on the supply pipe or in the alternative providing separate purging piping.

According to a fifth embodiment of the invention, the predetermined gas for preheating the metal strip in the preheating section of an annealing furnace is a circulating gas. In the heat exchanger, by passing the circulating gas through the regenerator, temperatures are raised. The regenerator has three sections: a heating section combustion exhaust gas path for passing a heating section combustion exhaust gas to supply a sensible heat of the heating section combustion exhaust gas of the annealing furnace to the regenerator; a purging gas path for passing a purging gas to remove an exhaust gas which remains in the sensible heat recovery path when the temperature of the circulating gas is raised through the regenerator; and a circulating gas path for heating the circulating gas. While the regenerator continuously or intermittently rotates, a certain segment of the regenerator changes its role from the heating section combustion exhaust gas path to the purging gas path, and then to the circulating gas path in accordance with the rotation. The heat exchanger repeats this process sequentially in the metal strip annealing furnace.

Also, in the fifth embodiment of the invention, when the relationship between a sectional area of the purging gas passing section and a sectional area of the circulating gas passing section, satisfies following condition, the effects of the invention can be efficiently attained:

$$S1/S2 \geqq 1/[(Qa/V1)-1] \quad (1)$$

wherein:

$S_1$ is the sectional area ($m^2$) of the purging gas passing section;

$S_2$ is the sectional area ($m^2$) of the circulating gas passing section;

$Q_a$ is the average flow rate ($m^3$/sec) of air passing through the regenerator; and $V_1$ is the approach volume ($m^3$/sec) of circulating gas passing section.

To prevent the circulating gas from being contaminated, static pressure of the purging gas is set higher than the static pressure of the exhaust gas. To effect this, the purging gas supply path may be branched from the circulating gas supply path or connected to an incoming path of the purging gas passing section and to an outgoing path of the circulating gas passing section.

The material of the regenerator is preferably $Al_2O_3$, SUS310 or SUS316 according to Japanese Industrial Standards, or another material superior in heat and corrosion resistance.

BRIEF DESCRIPTION OF TH DRAWINGS

DETAILED DESCRIPTION OF PREFERRED EMBODIMENTS

Figure 1:
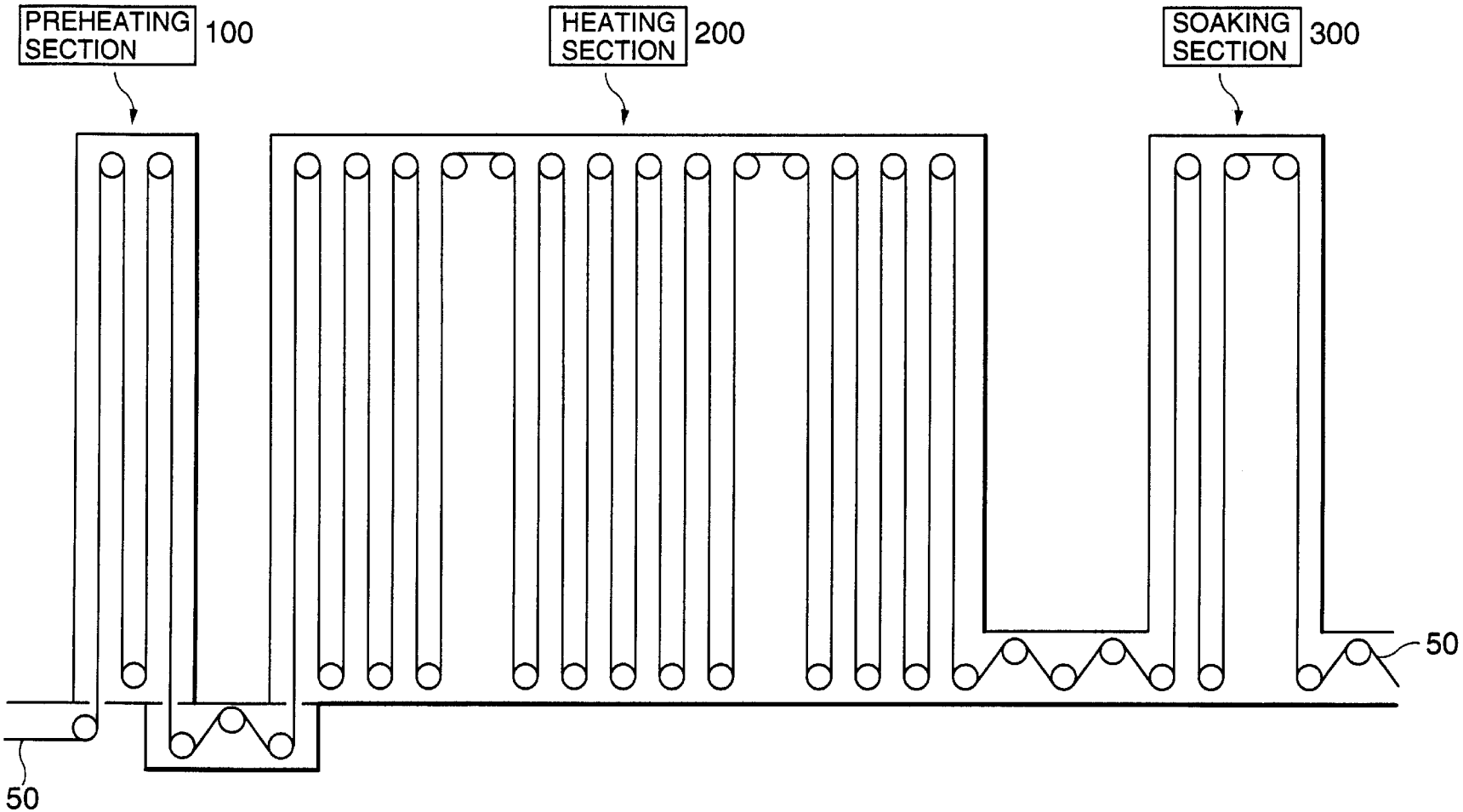
FIG. 1 is a schematic representation of a continuous metal-strip heat treating furnace.

FIG. 1 shows an embodiment of a continuous annealing furnace for a strip (cold rolled steel plate) in which a continuous metal-strip heat treating furnace according to the invention is operated.

FIG. 1 shows the construction of a vertical continuous annealing furnace which continuously anneals a strip 50. T he continuous annealing furnace in FIG. 1 is formed by an incoming-side device (not shown) which has a coil rewinder, a welding machine, a washing machine and the like, a preheating section 100, a heating section 200, a soaking section 300 and an outgoing-side device (not shown) which has a plate temperature adjusting section, for adjusting a plate temperature as required, a heat treating section, a shearing machine, a winder and the like. These devices are all constructed in a tower-like vertical configuration due to size restrictions in the installation area.

After welding different sections of the material together to form a continuous strip, the strip is sequentially passed through the preheating section 100, the heating section 200 and the soaking section 300. It is thereafter passed through the plate temperature adjusting section and the thermal treating section if necessary. Finally, the strip is cooled to a normal temperature.

The heating section 200 and the soaking section 300 are similar or the same in structure as conventional heating and soaking sections. In the heating section 200, the strip material, which has been continuously supplied from the incoming-side device and preheated, is heated for example to a recrystallization temperature or higher. Specifically, when the strip material is cold rolled steel plate formed at an in-furnace temperature of 900 to 950° C., the steel plate is heated to a strip temperature of 700 to 800° C. The heated cold rolled steel plate is held for a required period of time in the soaking section 300, then reaches the plate temperature adjusting section. Therefore, multiple radiant tubes are disposed in the same manner as the related prior art in the vicinity of the strip 50 where it passes through the heating section 200. Combustion exhaust gases having passed the radiant tubes are supplied to the regenerative heat exchanger described later.

Figure 2:
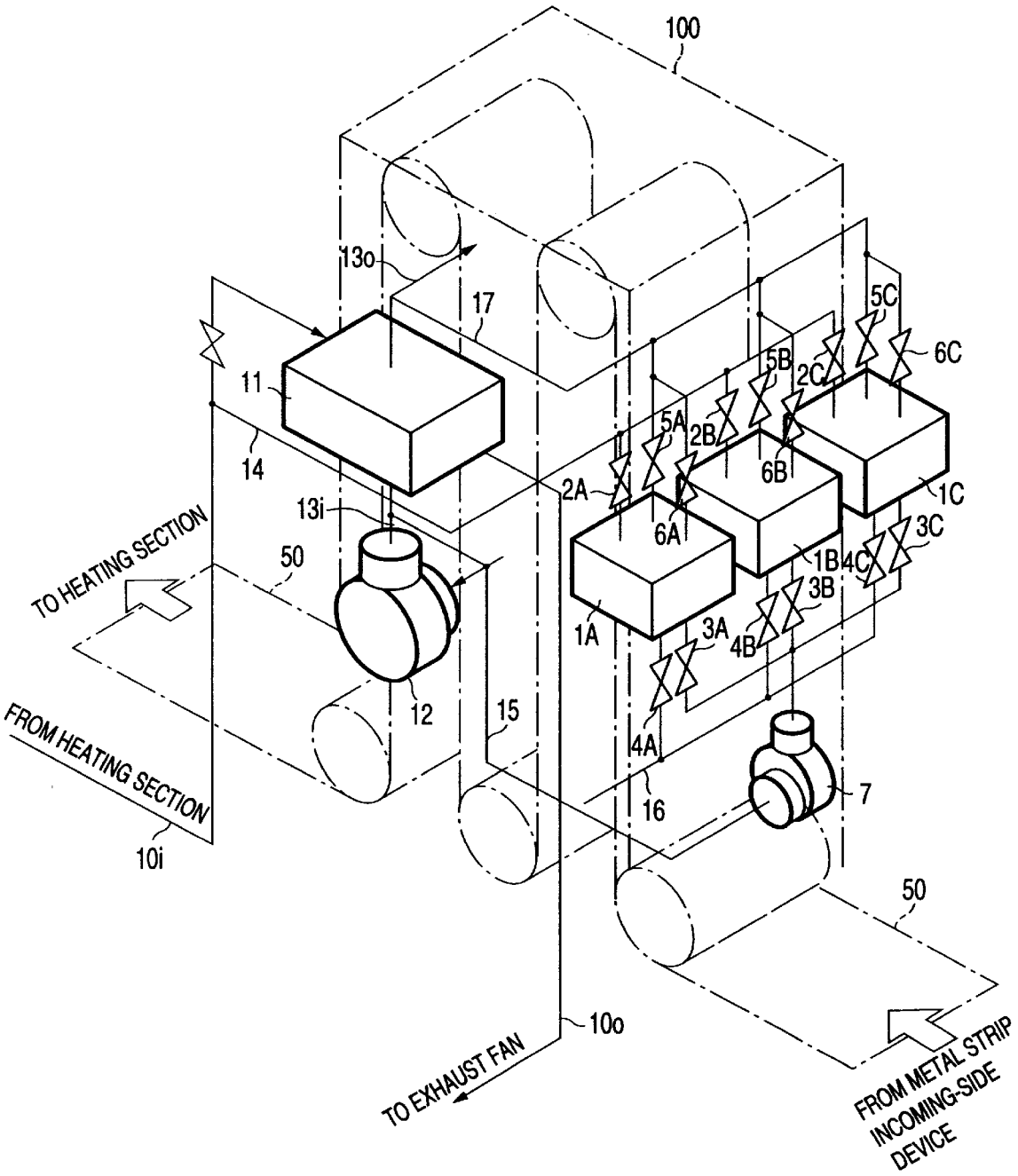
FIG. 2 is a perspective, schematic representation of the preheating section in the continuous annealing furnace shown in FIG. 1.

The preheating section is shown in FIG. 2. As shown in FIG. 2, the combustion exhaust gas exhausted from the radiant tubes of the heating section is supplied through existing exhaust gas incoming piping **10*i* to existing convective heat exchanger 11. The convective heat exchanger 11 is disposed on one side of the preheating section, and is exhausted through the existing exhaust gas outgoing piping 10*o* to an exhaust fan (not shown). Atmospheric gas (air) is supplied to the convective heat exchanger 11 from a suction fan 12 for taking in the atmospheric gas (i.e. air) from the preheating section via the existing air incoming piping 13*i*. Subsequently, the air heated by the convective heat exchanger 11 is passed through the existing air outgoing piping 13*o* to a plenum chamber or another diffusion blower (not shown), which blows the air to the strip 50 as it is passes through the preheating section. Specifically, the multiple tubes (not shown) are arranged, in the convective heat exchanger 11. The air supplied to the tubes is heated by the convective heat transmitted from the high-temperature combustion exhaust gas which flows around the tubes. The heated air is then blown from the plenum chamber to the strip 50 to heat the strip 50**.

As shown In FIG. 2, on a face of the preheating section, three regenerative heat exchangers 1A, 1B and 1C are provided. Each of the regenerative heat exchangers 1A, 1B and 1C has a regenerating chamber with a spherical or short tubular regenerator contained therein and two connection chambers which are interconnected in such a manner so that they can be ventilated. From the existing incoming exhaust gas piping 10*i*, an incoming exhaust gas pipe 14 is additionally branched into three portions which are connected via incoming exhaust gas valves 2A, 2B and 2C to the connection chambers of the regenerative heat exchangers 1A, 1B and 1C, respectively. The existing incoming air piping 13*i* is additionally branched and connected to incoming air piping 15 that has an air supply fan 7 interposed halfway between the incoming air valves and the connective heat exchange 11 and the section fan 12. The incoming air piping 15 is branched into three portions which are connected via incoming air valves 3A, 3B and 3C to the connection chamber of the regenerative heat exchangers 1A, 1B and 1C, respectively. The existing outgoing exhaust gas piping 10*o* is additionally branched and connected to exhaust gas outgoing piping 16 whose tip is branched into three portions which are connected via outgoing exhaust gas valves 4A, 4B and 4C to the connection chambers of the regenerative heat exchangers 1A, 1B and 1C, respectively. The existing outgoing air piping 13*o* is additionally branched and connected to the outgoing air piping 17 whose end is branched into three portions which are connected via the outgoing air valves 5A, 5B and 5C to the connection chambers of the regenerative heat exchangers 1A, 1B and 1C, respectively. Each of the three end portions of the outgoing air piping 17 is further branched into two portions. The further branched portions are connected via purging valves 6A, 6B and 6C to the connection chambers of the regenerative heat exchangers 1A, 1B and 1C, respectively. Except for the purging valves 6A, 6B and 6C, and the associated pipes, flow rates of the valves 2A, 2B and 2C and the associated pipes are equal or substantially equal to one another. Furthermore, the flow rates of the purging valves 6A, 6B and 6C, and the associated pipes, are set less than the flow rates of the other valves and pipes. Further, the piping and valve system connected to the regenerative heat exchanger 1A is denoted as System A, a piping and valve system connected to the regenerative heat exchanger 1B as System B, and a piping and valve constitution connected to the regenerative heat exchanger 1C is denoted as System C.

Figure 3:
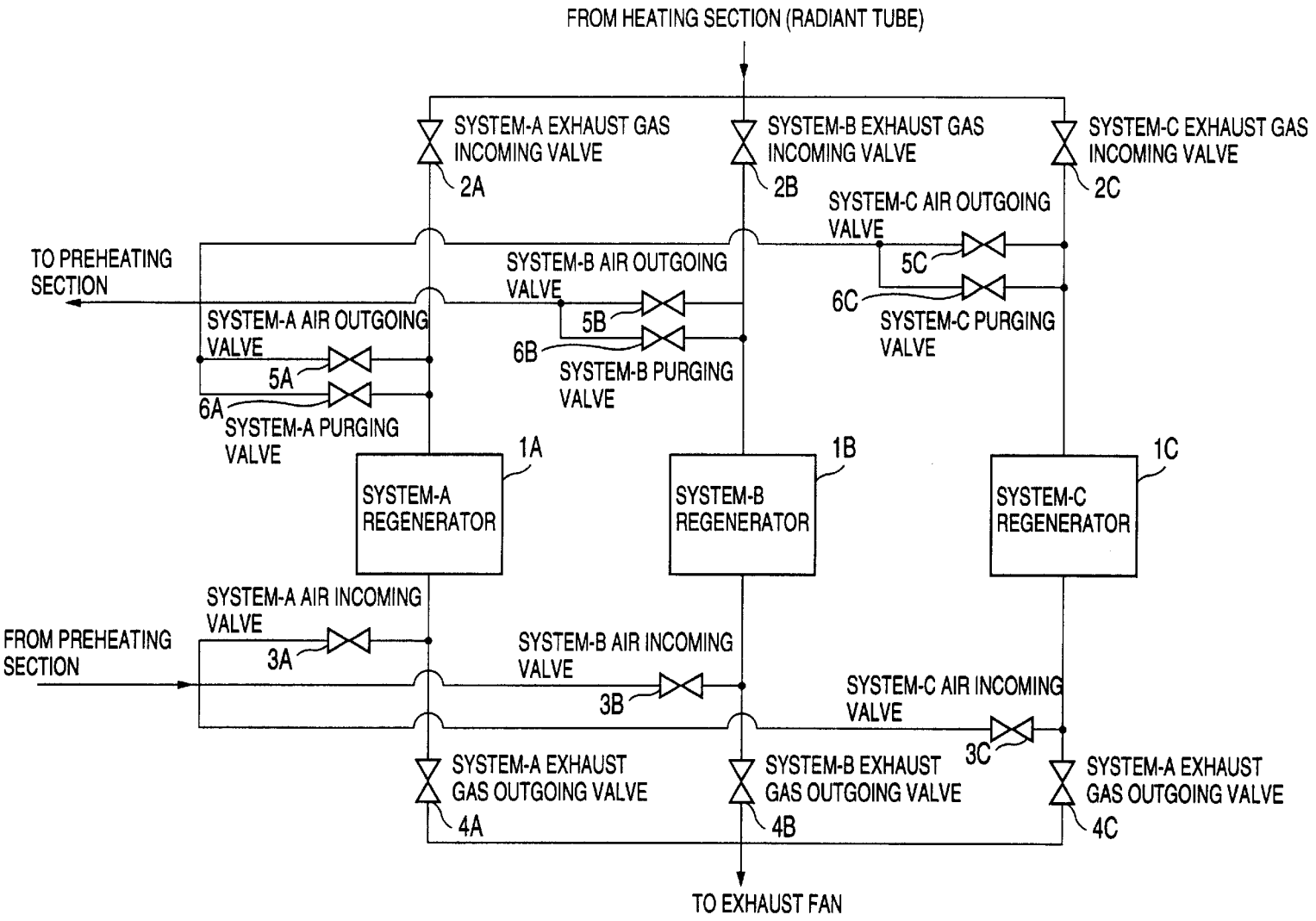
FIG. 3 is a diagram of the valve system of the preheating section shown in FIG. 2.

The valve system is shown in FIG. 3. The opening and closing of the valves is controlled by a processing computer (not shown). The control is shown in the timing diagram of FIG. 4.

Figure 4:
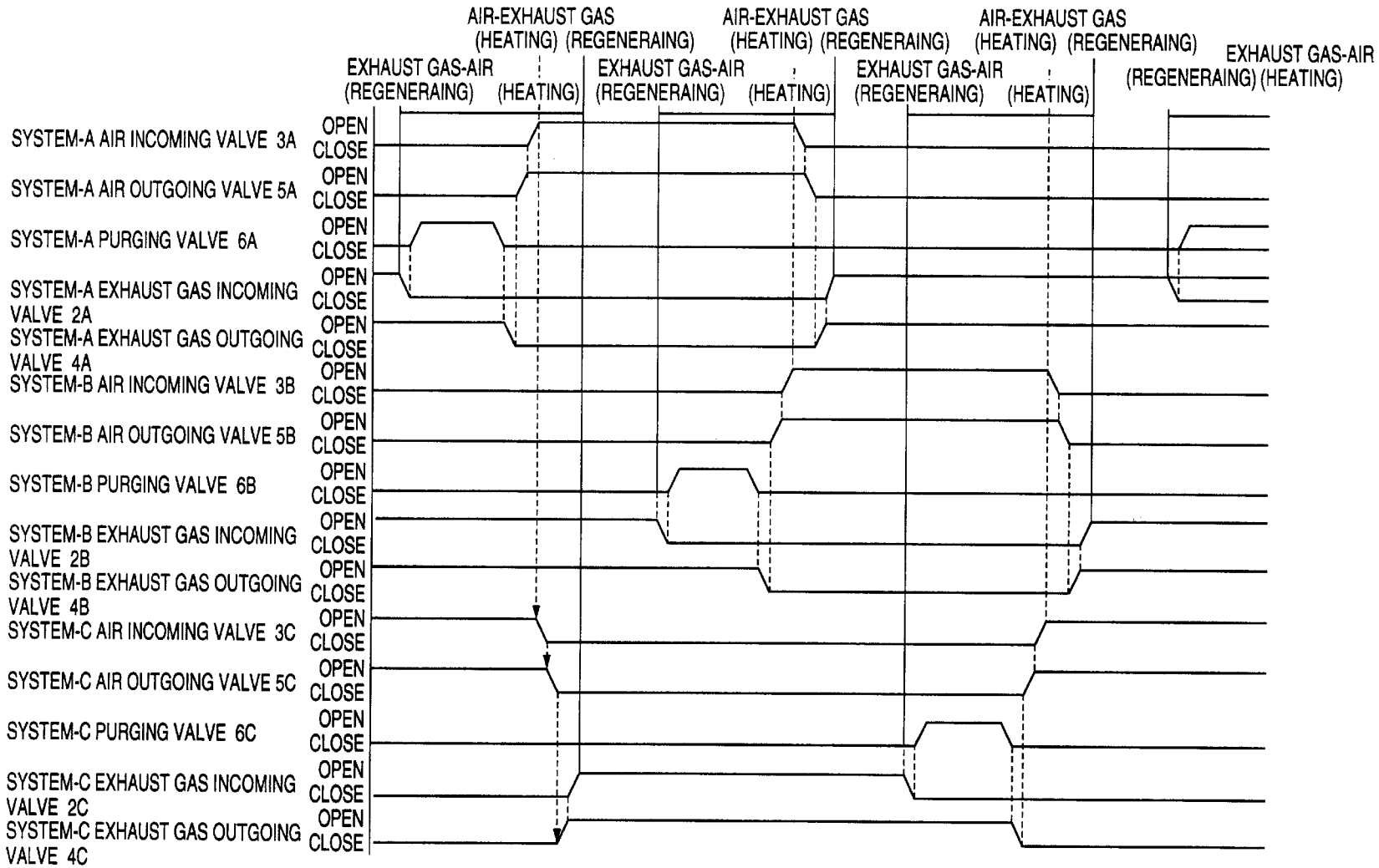
FIG. 4 is a timing diagram of the valve system shown in FIG. 3.

As shown in the timing diagram of FIG. 4, for example, the exhaust gas incoming valves 2A and 2B and the outgoing exhaust gas valves 4A and 4B of the Systems A and B are opened, while the incoming air valve 3C and the outgoing air valve 5C of the System C are opened. All other valves are closed. Specifically, in the regenerative heat exchangers 1A and 1B of the Systems A and B, the sensible heat of the combustion exhaust gas is stored in the regenerators, while the air sensible heat is raised from the regenerator of the System C regenerative heat exchanger 1C which has reserved the heat. The high-temperature air is then blown from the plenum chamber to the strip 50. For example, if the temperature of the regenerator of the System A regenerative heat exchanger 1A, which has stored heat, reaches the vicinity of its upper limit and no more heat continues to be stored, then the System A incoming exhaust gas valve 2A is closed so that no combustion exhaust gas can be supplied to the regenerator of the System A regenerative heat exchanger 1A. Even in this condition, the System C regenerative heat exchanger 1C can blow the high temperature air via the air supply fan 7 and the additional outgoing air piping 17 to the strip as it passes through the preheating section 100.

Subsequently, when the System A incoming exhaust gas valve 2A is completely closed, the System A purging valve 6A is opened. At this time, the System A regenerative heat exchanger 1A is still filled with the combustion exhaust gas. However, the flow rate of the purging valve 6A and the associated piping is set less than the flow rate of the System C outgoing air valve 5C and its associated piping. Therefore, most of the high-temperature air exhausted from the System C outgoing air valve 5C is still blown to the strip in the preheating section.

A portion of air is supplied from the additional outgoing air piping 17 through the System A purging valve 6A into the System A regenerative heat exchanger 1A. The combustion exhaust gas which filled in the regenerative heat exchanger 1A is exhausted from the System A outgoing exhaust gas valve 4A which is still open. Thereby, the regenerative heat exchanger 1A is purged with the high-temperature air. At this point, the regenerator of the System A regenerative heat exchanger 1A is further heated by the high-temperature air.

After the System A regenerative heat exchanger 1A is purged with the high-temperature air, the System A purging valve 6A is closed. After the purging valve 6A is completely closed, the System A outgoing exhaust gas outgoing valve 4A is closed. After the outgoing exhaust gas valve 4A is completely closed, the System A air outgoing valve 5A is opened. When the outgoing air valve 5A is completely opened, the System A incoming air valve 3A is opened to exhaust the high-temperature air from the System A regenerative heat exchanger 1A, which is blown to the strip in the preheating section 100. After the System A incoming air valve 3A is completely open, the System C incoming air valve 3C is closed. After the incoming air valve 3C is completely closed, the System C air outgoing valve 5C is closed. After the air outgoing valve 5C is completely closed, the System C outgoing exhaust valve 4C is opened. After the outgoing exhaust gas outgoing valve 4C is completely open, the System C incoming exhaust gas valve 2C is opened, in order to store the sensible heat of the combustion exhaust gas in the regenerator of the System C regenerative heat exchanger 1C. During this time, as described above, after the high-temperature air is blown from the System A regenerative heat exchanger 1A to the strip, the System C regenerative heat exchanger 1C stops exhausting the high-temperature air. Therefore, the high-temperature air continues to be blown to the strip. Hence, no variation in temperature occurs in the strip supply direction. During this time, in the System B regenerative heat exchanger 1B, the sensible heat of the combustion exhaust gas continues to be stored in the regenerator.

Subsequently, when the temperature of the regenerator of the System B regenerative heat exchanger 1B, to which the heat continues to be stored, reaches the vicinity of its upper limit, in the same manner as when the supply of the high-temperature air is switched from the System C regenerative heat exchanger 1C to the System A regenerative heat exchanger 1A, the system-B exhaust gas incoming valve 2B is closed. Thereby, the combustion exhaust gas is not supplied to the regenerator of the System B regenerative heat exchanger 1B. When the System B incoming exhaust gas valve 2B is completely closed, the System B purging valve 6B is opened. In the same manner as described above, the high-temperature air exhausted from the System A regenerative heat exchanger 1A, via the outgoing air valve 5A, is still blown to the strip in the preheating section 100. Nonetheless, a portion of this air is supplied through the System B purging valve 6B into the System B regenerative heat exchanger 1B. The combustion exhaust gas in the regenerative heat exchanger 1B is exhausted from the System B outgoing exhaust gas valve 4B. Accordingly, the regenerative heat exchanger 1B is purged with the high-temperature air.

After the System B regenerative heat exchanger 1B is purged with the high-temperature air, the System B purging valve 6B is closed. After the purging valve 6B is completely closed, the system-B exhaust gas outgoing valve 4B is closed. After the outgoing exhaust gas valve 4B is completely closed, the System B outgoing air valve 5B is opened. When the air valve 5B is completely open, the System B incoming air valve 3B is opened to exhaust the high-temperature air from the System B regenerative heat exchanger 1B, which is then blown to the strip in the preheating section 100. After the System B incoming air valve 3B is completely open, the System A incoming air valve 3A is closed. After the incoming air valve 3A is completely closed, the System A outgoing air valve 5A is closed. After the outgoing air valve 5A is completely closed, the System A outgoing exhaust gas valve 4A is opened. After the outgoing exhaust gas valve 4A is completely open, the System A incoming exhaust gas valve 2A is opened to store the sensible heat of the combustion exhaust gas in the regenerator of the System A regenerative heat exchanger 1A.

When the temperature of the regenerator in the System C regenerative heat exchanger 1C, to which the heat continues to be stored, reaches the vicinity of the upper limit, the System C incoming exhaust gas valve 2C is closed, so that the combustion exhaust gas is not supplied to the regenerator of the System C regenerative heat exchanger 1C. When the System C incoming exhaust gas valve 2C is completely closed, the System C purging valve 6C is opened. In the same manner as described above, a portion of the high-temperature air exhausted from the System B regenerative heat exchanger 1B, via the air outgoing valve 5B, is supplied through the System C purging valve 6C into the system-C regenerative heat exchanger 1C. The combustion exhaust gas in the regenerative heat exchanger 1C is exhausted from the System C outgoing exhaust gas valve 4C. Accordingly, the regenerative heat exchanger 1C is purged of the high-temperature air.

After the System C regenerative heat exchanger 1C is purged with the high-temperature air, the System C purging valve 6C is closed. After the purging valve 6C is completely closed, the System C outgoing exhaust gas valve 4C is closed. After the outgoing exhaust gas valve 4C is completely closed, the System C outgoing air valve 5C is opened. When the outgoing air outgoing valve 5C is completely open, the System C incoming air valve 3C is opened to exhaust the high-temperature air from the System C regenerative heat exchanger 1C, which is blown to the strip in the preheating section 100. Subsequently, after the System C air incoming valve 3C is completely open, the system-B incoming air valve 3B is closed. After the incoming air valve 3B is completely closed, the System B outgoing air valve 5B is closed. After the outgoing air valve 5B is completely closed, the System A outgoing exhaust gas valve 4B is opened. After the outgoing exhaust gas valve 4B is completely open, the System B incoming exhaust gas valve 2B is opened, to store the sensible heat of the combustion exhaust gas in the regenerator of the system-B regenerative heat exchanger 1B.

Figure 8:
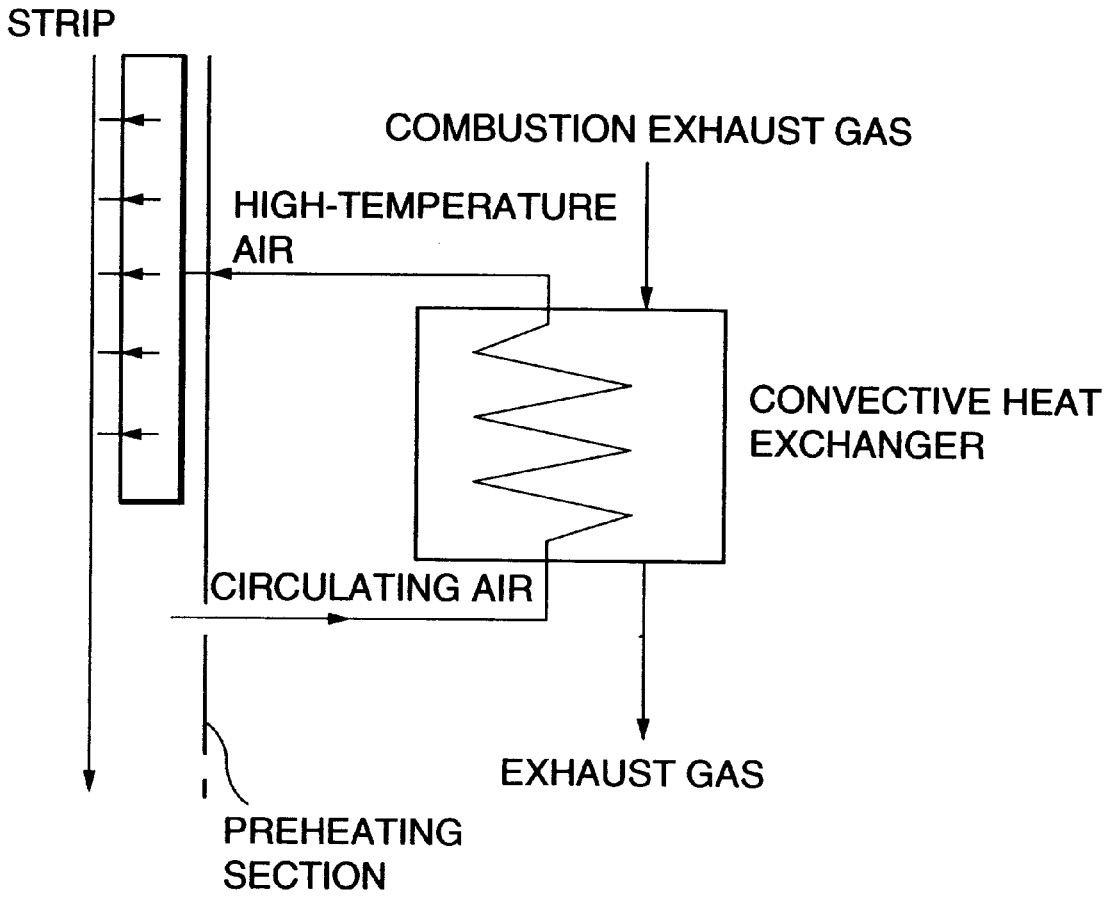
Fig.8 PRIOR ART
FIG. 8 is a schematic representation of a preheating section in a prior art continuous annealing furnace.

In the conventional continuous annealing furnace shown in FIG. 8, the combustion exhaust gas from the radiant tubes of the heating section is supplied to the convective heat exchanger, while air is supplied to the tubes in the convective heat exchanger. The air in the tubes is heated by convective heat transmitted from the sensible heat of the combustion exhaust gas, and is blown to the strip in the preheating section to heat (preheat) the strip. The set temperature of the strip supplied from the heating section is 800° C.

Figure 9:
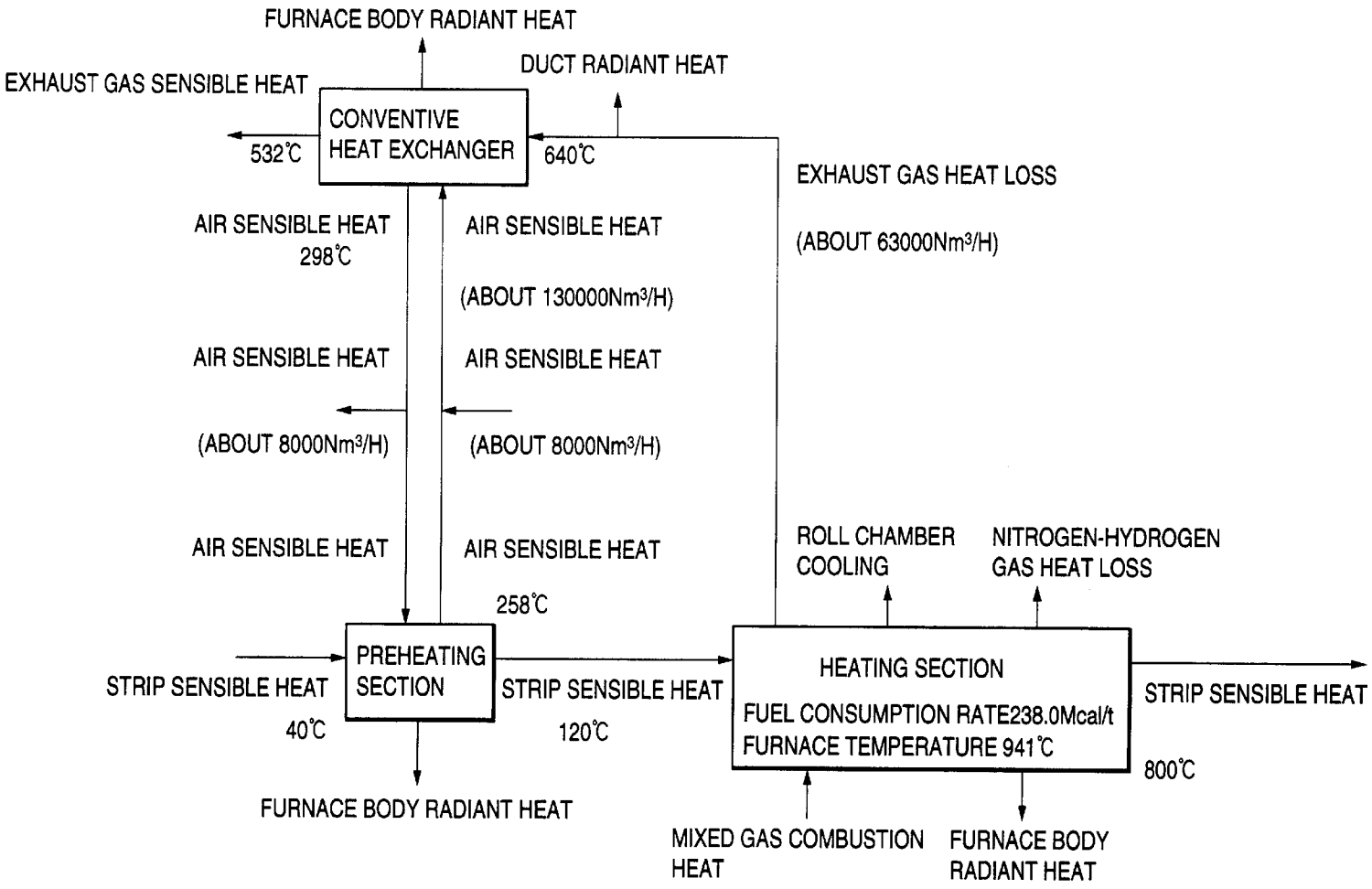
FIG. 9 shows the flow of heat in the prior art continuous annealing furnace shown in FIG. 8.

In the heating section, as shown in FIG. 9, the combustion heat of fuel gas or M gas (a mixture of blast-furnace gas and coke-furnace gas) is supplied from the burners and the radiant tubes. Substantially, heat loss results from the radiant heat from the furnace body and exhaust of NH gas (hydrogen-nitrogen gas mixture in the case of an in-furnace atmosphere being a reduction atmosphere), and further heat loss results from the cooling of the roll chamber which cools the hearth roll and the like. Overall, the radiant heat and the heat loss are small. However, strip sensible heat and heat loss from combustion exhaust gas account for a larger percentage of lost heat. However, the strip sensible heat is disregarded, because it is required to attain the target temperature of the object to be heated. In the conventional continuous annealing furnace, the combustion exhaust gas flow rate is about 63 $kNm^3$/hr.

While the combustion exhaust gas passes through a duct (piping), because of the radiant heat from the duct, its temperature is decreased to 640° C. before it reaches the convective heat exchanger. In the convective heat exchanger, only an air sensible heat of 298° C. can be recovered from the sensible heat of the combustion exhaust gas. Therefore, even when the air is continuously supplied to the preheating section and blown to the strip, a strip sensible heat which is 40° C. on the incoming side of the preheating strip can be increased only to 120° C. on the outgoing side of the preheating section. Therefore, the furnace temperature in the heating section needs to be set to 941° C., and the fuel consumption rate in the heating section is subsequently as high as 996.3MJ/t-steel. Additionally, in the conventional continuous annealing furnace, the flow rate of air supplied or recycled to the preheating section is very high, about 13 $kNm^3$/hr. This is because to increase the strip temperature as high as possible, by blowing a low-temperature air to the strip, as seen from the effect of the convective heat, the flow rate of air to be blown to the strip has to be increased.

Figure 5:
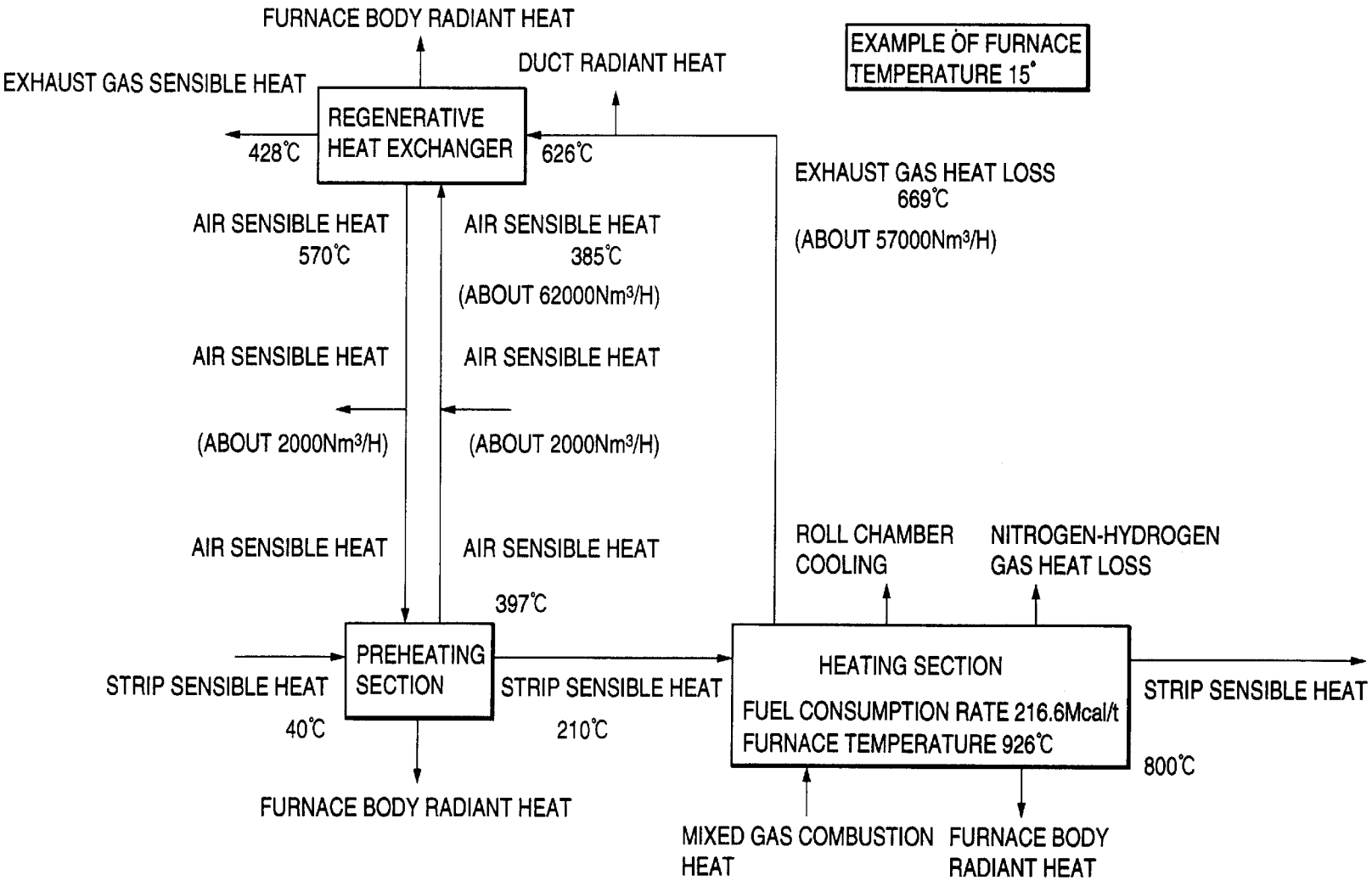
FIG. 5 shows the flow of heat in the continuous annealing furnace shown in FIG. 1.

In the previously-described regenerative heat exchanger, the recovery efficiency of the combustion exhaust gas sensible heat is so high that the sensible heat of the air to be blown from the regenerative heat exchanger to the strip in the preheating section is increased. Specifically, the temperature of the air blown to the strip is further raised, thereby increasing the temperature of the strip which is supplied to the preheating section. Finally, the temperature of the radiant tubes in the heating section is lowered to lengthen the high-temperature life of the radiant tubes, while the fuel consumption rate in the heating section is reduced to save cost. In this embodiment, as shown in FIG. 5, the temperature of the radiant tubes in the heating section can be set to 926° C., which is 15° C. lower as compared with the related art. Additionally, the set temperature of the strip supplied from the heating section remains the same at 800° C.

In this embodiment, since the furnace temperature can be finally lowered, the supply quantity of the fuel gas or M gas is decreased. As a result, the combustion exhaust gas flow rate is decreased by approximately 6000 $Nm^3$/hr from the related art to about 57 $kNm^3$/hr. In this case, the exhaust gas temperature is 669° C., and the combustion exhaust gas is lowered in temperature to 626° C. due to duct radiant heat upon reaching the regenerative heat exchanger. Subsequently, in the regenerative heat exchanger, because of its high heat recovery ratio, the air sensible heat of 570° C. can be recovered from the combustion exhaust gas sensible heat, and supplied to the preheating section to be blown to the strip. The strip sensible heat which is 40° C. on the incoming side of the preheating section can be increased by 90° C. from the related art to 210° C. on the outgoing side of the preheating section. The air is then supplied to the heating section, thereby attaining the furnace temperature of 926° C. as described above.

The fuel consumption rate in the heating section can be reduced by 89.6MJ/t-steel from the related art, to 906.7MJ/t-steel. In this embodiment, the flow rate of air supplied or recycled to the preheating section can also be reduced from approximately 68 $kNm^3$/hr of the related art down to about 62 $kNm^3$/hr. This is because the temperature of air to be blown to the strip is remarkably higher than in the conventional annealing furnace. Even with a small quantity of blown air, the temperature of the strip, as the energy efficiency, can be efficiently raised as well.

Figure 6:
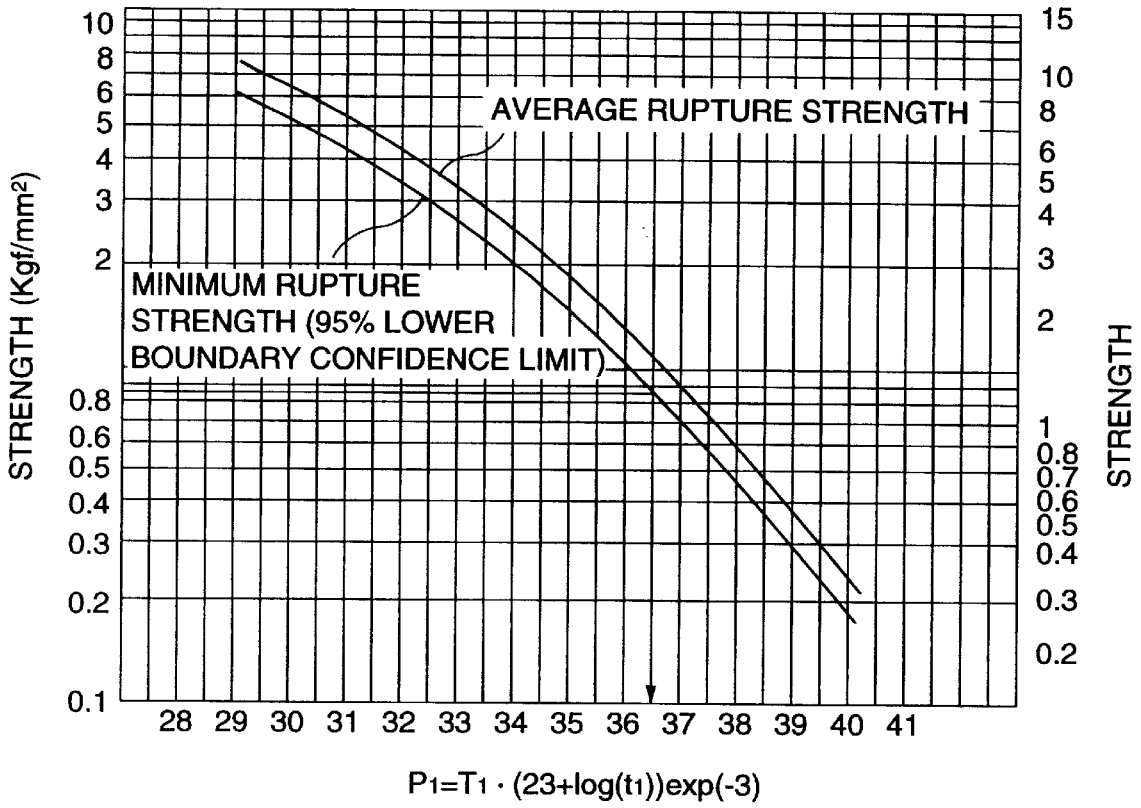
FIG. 6 is a plot of the life evaluation characteristic of the radiant tube.

FIG. 6 plots the stress generated on the radiant tube on against the constant value P, which is an inherent property of a material and is calculated as:

$$P_1=T_1\cdot[23+\log(t_1)]^{-3} \quad (2)$$

where:

$T_1$ is the radiant tube temperature; and $t_1$ is its lifetime.

FIG. 6 further shows a correlation between the radiant type and strength with an average rupture strength and a minimum rupture strength. The average rupture strength indicates the relationship between the stress generated and the point where the radiant tube breaks at the highest experimental/statistical probability with the constant value P. The minimum rupture strength indicates the relationship between the stress generated and the point where rupture can be avoided at a probability of 95% with the constant value P. The generated stress applied to the radiant tube is obtained from a sum of the bending stress caused by the dead weight of the tube, the thermal stress in an axial direction, the thermal stress in a sectional direction, the thermal stress in a peripheral direction and the like. The stress other than the bending stress is obtained as a function of the generated temperature of the radiant tube. In this embodiment, the total stress generated on the radiant tube is about 0.852 $kgf/mm^2$. Therefore, the constant value P is about 36.5 in accordance with the minimum rupture strength curve in FIG. 6.

Figure 7:
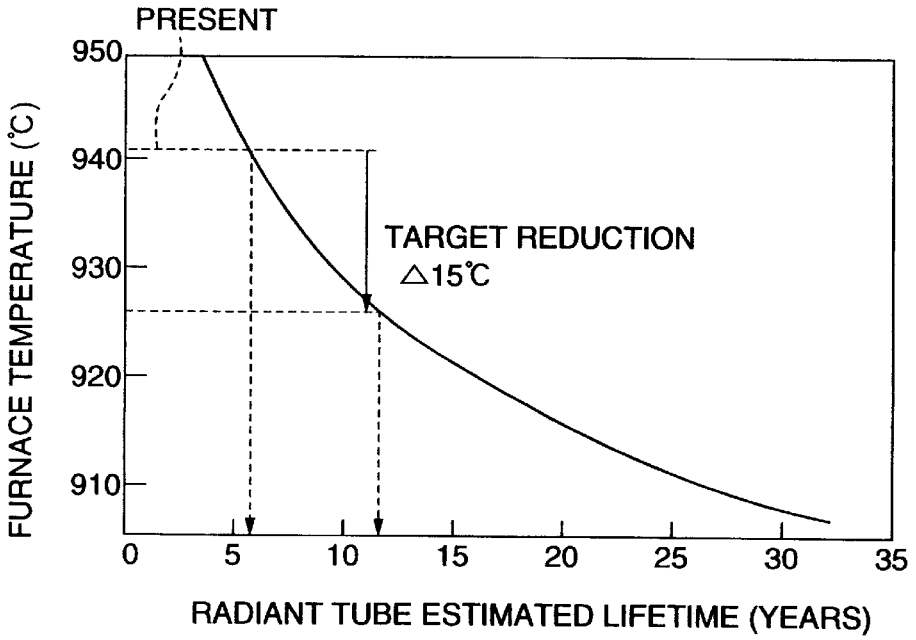
FIG. 7 is a plot of the estimated life of the radiant tube as a function of furnace temperature.

Subsequently, the constant value $P_1$ is fixed, and a function of the lifetime $t_1$ is obtained by as a function of the furnace temperature (radiant tube temperature) $T_1$. FIG. 7 plots the radiant tube expected lifetime, in years, as a function of furnace temperature. As shown by FIG. 7, the lifetime $t_1$ (in years) is an index function of an inverse number of the radiant tube temperature $t_1$ (furnace temperature). Therefore, during use at the above-described high temperatures, a slight reduction in temperature produces the remarkable effect of lengthening the radiant tubes' lifetime. For example, an estimated lifetime of only 5.5 years at the present furnace temperature of 941° C. is lengthened twice or more to 12 years at a temperature of 926° C.—a decrease of only 15° C. As described above, in the heating section of the continuous annealing furnace containing a hundred, to several hundreds of radiant tubes, arranged in an integral furnace body, the effect is enlarged. Not only is there a large reduction in the radiant tube material cost, but also a large reduction in maintenance, repair or another operational costs.

In this invention, the gas to be blown to the strip in the preheating section is air, but any other gas can be blown to the strip in the preheating section. Additionally, the metal strip to be continuously heat treated is not restricted to a strip, and the blowing to the strip can be performed by a slit nozzle, a manifold type nozzle or other means.

Also, in this invention, the combustion exhaust gas exhausted from the radiant tubes in the heating section has been described. However, the combustion exhaust gas may include the exhaust gas from more than just the heating section. For example, the combustion exhaust gas from the soaking section or another device or another-high temperature gas can also be used.

Further, only a continuous annealing furnace for continuously annealing the strip has been described. However, the continuous heat treating furnace of the invention can be applied to any continuous heat treating furnace that has at least a heating section and a preheating section.

As described above, in the metal-strip continuous heat treating furnace according to the first embodiment of the invention, the sensible heat of the combustion exhaust gas supplied from the burners to the radiant tubes in the heating section is collected and stored in the regenerator of the large-sized regenerative heat exchanger. By supplying air, or another predetermined gas, to the regenerator, the sensible heat of the combustion exhaust gas is collected and recovered to the sensible heat of the predetermined gas. By blowing the gas to the metal strip in the preheating section, the metal strip is preheated. In this case, by passing the regenerator in the regenerative heat exchanger, the predetermined gas obtains a sufficiently high temperature. By blowing the high-temperature gas directly to the metal strip, the temperature of the metal strip, as it leaves the preheating section, is remarkably higher as compared with the conventional annealing furnace. Therefore, the increase in temperature of the metal strip required in the heat exchanger section is decreased, and accordingly, the temperature required for the radiant tubes can be lowered. In this lower temperature range, the radiant tubes have a remarkably enhanced lifetime, plus the fuel consumption rate in the burners can be decreased.

In the metal-strip continuous heat treating furnace according to the second embodiment of the invention, three or more regenerative heat exchangers are used. From at least one of the regenerative heat exchangers, the sensible heat of the combustion exhaust gas reserved in the regenerator can be recovered as the sensible heat of the predetermined gas. The predetermined gas is blown to the metal strip in the preheating section, and the sensible heat of the combustion exhaust gas is stored in the regenerators of the remaining regenerative heat exchangers. To achieve this condition, the control valves are sequentially opened and closed. Therefore, the high-temperature predetermined gas can be continually blown to the metal strip from at least one of the regenerative heat exchangers, and variations in temperature in the metal strip supply direction can be eliminated. Simultaneously, in the remaining regenerative heat exchangers, the sensible heat of the combustion exhaust gas can be efficiently stored in the regenerators.

Further, in the metal-strip continuous heat treating furnace according to a third embodiment of the invention, while the valve for purging the predetermined gas is open, the valve for exhausting the combustion exhaust gas is opened. Thereby, the combustion exhaust gas is exhausted from the relevant regenerative heat exchanger, and the heat exchanger is purged with the predetermined gas. Subsequently, after closing the valve for purging the predetermined gas, the valve for exhausting the combustion exhaust gas is closed. Then, the valve for exhausting the predetermined gas is opened. This allows the metal strip in the preheating section to be accurately blown by the predetermined gas.

Also, in the metal-strip continuous heat treating furnace according to a fourth embodiment of the invention, the flow rate of the system for purging the predetermined gas is set less than the flow rate of the system for exhausting the predetermined gas into the preheating section. Thereby, the high-temperature predetermined gas from the relevant regenerative heat exchangers is continually exhausted into the preheating section. Using a portion of the predetermined gas, the relevant regenerative heat exchanger can be securely purged.

According to a fifth embodiment of the invention, the regenerator is divided into at least three sections: a regenerating zone (heating section combustion exhaust gas path), which supplies the sensible heat of the exhaust gas to the regenerator; a purging zone (purging gas path), which removes the exhaust gas residing in the regenerator after the temperature of circulating gas has risen closer to the limit temperature in the regenerating zone; and a heating zone (circulating gas path), which raises the temperature of the circulating gas by passing the gas through the purged regenerator. These zones are repeatedly cycled, allowing the sensible heat of the high-temperature exhaust gas to be efficiently recovered. Additionally, since the regenerator itself rotates, the number of pipes and valves can be reduced.

Figure 10:
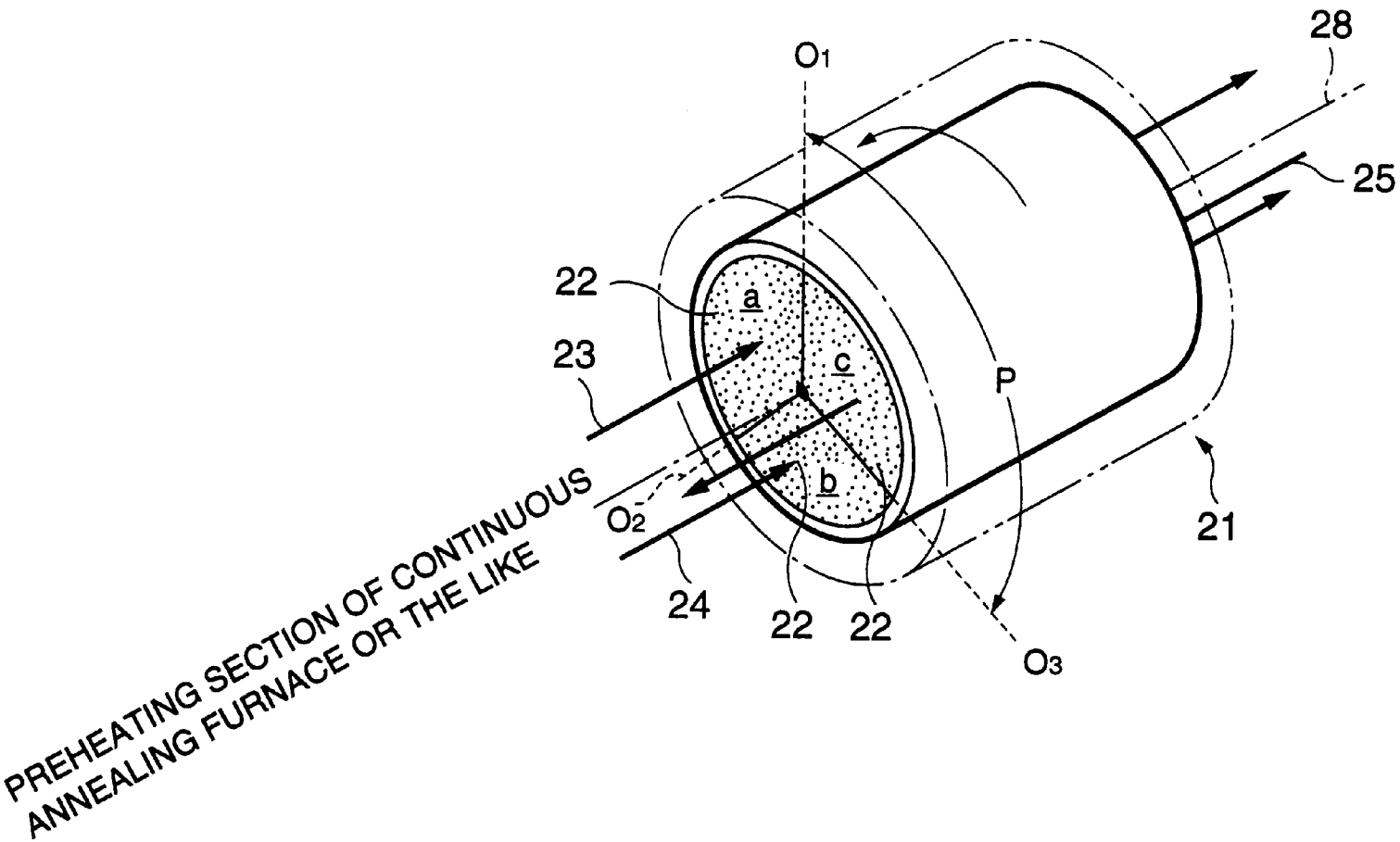
FIG. 10 shows a first embodiment of a regenerative heat exchanger according to the invention.

FIG. 10 schematically shows a heat exchanger for the metal-strip annealing furnace according to the fifth embodiment of the invention. In FIG. 10, a heat exchanger body 21 (shown by a two-dotted line) is rotatable about a rotation axis 28, in which three regenerators 22 are disposed. The regenerators 22 are provided with a heating section exhaust gas path 23 connected from the heating section 200 of the continuous annealing furnace or the like, a purging gas path 24 and a circulating gas path 25 connected to the preheating section 100 of the continuous annealing furnace or the like.

As the heat exchanger body 21 is continuously rotated, the sensible heat of the exhaust gas from the heating section is recovered.

As the heat exchanger body 21 rotates, a first regenerator 22*a* shifts into the purging gas path 24. Purging gas is blown through the first regenerator 22*a*, forcing the exhaust gas and debris which remain after the combustion exhaust gas has passed to be removed. If the regenerator 22, after its temperature has been increased by the exhaust gas, is not purged, the circulating gas passed through the regenerator is blown to the metal, and any debris or the like included in the exhaust gas will stick to the metal strip. This results in a deterioration of the surface quality of the product.

As the first regenerator 22*a* shifts to the circulating gas path 25, circulating gas is blown into a first regenerator 22*a* allowing the circulating gas to recover the heat of the first regenerator 22*a*, thereby raising its temperature. The circulating gas is then supplied to the preheating section 100 of the continuous annealing furnace or the like.

Figure 11:
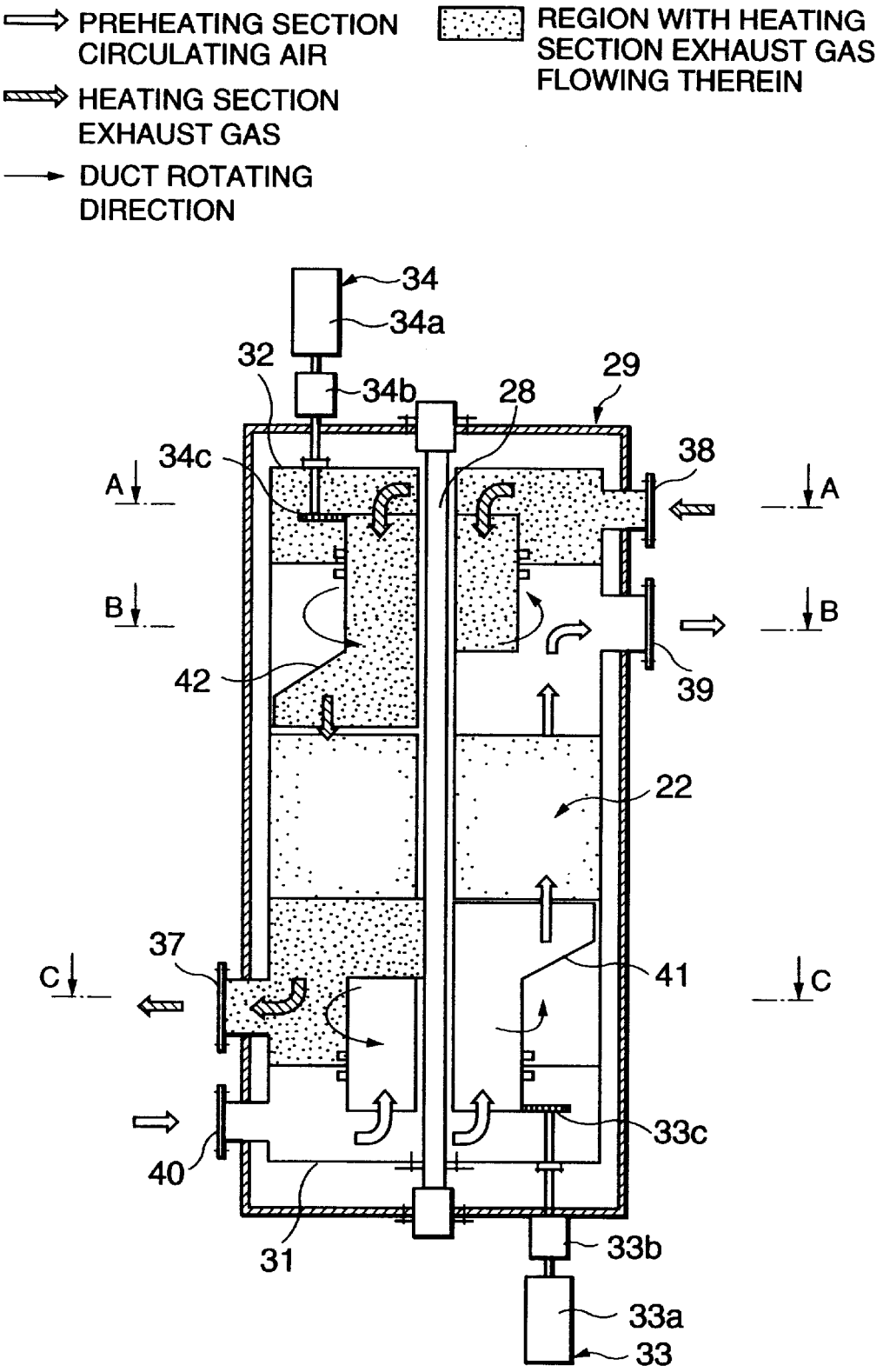
FIG. 11 shows a second embodiment of the regenerative heat exchanger according to the invention.
Figure 12:
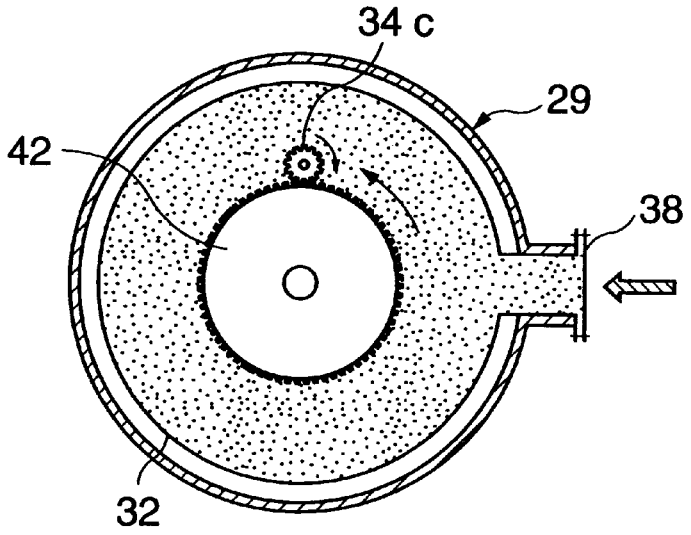
FIG. 12 is a first sectional view of the regenerative heat exchange shown in FIG. 11.

As the first regenerator 22*a* is switched from the heating section exhaust gas path 23 to the purging gas path 24, the second regenerator 22*b* is switched from the purging gas path 24 to the circulating gas path 25. At the same time, the third regenerator 22*c* switches from the circulating gas path 25 to the heating section exhaust gas path 23. This method of raising the circulating gas temperature is repeated in a cycle as long as the heat exchanger body 21 rotates and gasses are supplied from the paths 23, 24 and 25. Alternatively, the heat exchanger body 21 can be fixed and the chambers shown in FIG. 11, or another peripheral device can be rotated, to achieve the same effect.

In this type of heat exchanger, the gas pressure is set in such a manner that:

$$P_e < P_p \leqq P_c$$

where:

$P_e$ is the pressure of the heating section exhaust pipe;

$P_p$ is the pressure of the purging gas; and $P_c$ is the pressure of the circulating gas.

Even if one section is continuously rotated, the other sections are not largely influenced. However, especially when there is a strict accuracy requirement, buffer areas can be provided adjacent to the regenerators 22*a*–22*c*. The time during which one of the first regenerators 22*a*–22*c* stays in the heating section combustion exhaust gas path 23, the purging gas path 24 or the circulating gas path 25 is described by Eq. 3. As shown in Eq. (3), the cycle pitch $t_2$ is:

$$t_2 = P_2/V_2, \tag{3}$$

where:

$P_2$ is a length of the section as shown in FIG. 10, in meters; and $V_2$ is a rotational speed in meters per second.

Therefore, by changing the rotational speed, the pitch can be adjusted. Additionally, the heat exchanger body 21 can be continuously rotated by an electric motor or non-continuously rotated by using a cylinder and rod configuration. However, one skilled in the art will appreciate that there are other means of rotation. In any case, the rotational speed is set to about 0.5 to 4 rpm.

The sectional areas of the purging gas passing section and the circulating gas passing section preferably satisfy:

$$S_1/S_2 \geqq 1/[(Q_a/V_1)-1] \tag{4}$$

where:

$S_1$ is the sectional area of the purging gas passing section in square meters ($m^2$);

$S_2$ is the sectional area of the circulating gas passing section in separate meters ($m^2$);

$Q_a$ is an average flow rate of the air passing the regenerator connected to the purging gas path 24 in cubic meters per second ($m^3/s$); and $V_1$ is an approach volume of the circulating gas passing section in cubic meters per second ($m^3/s$).

When those conditions are satisfied, the circulating gas can be passed and the exhaust gas is completely purged.

Figure 16:
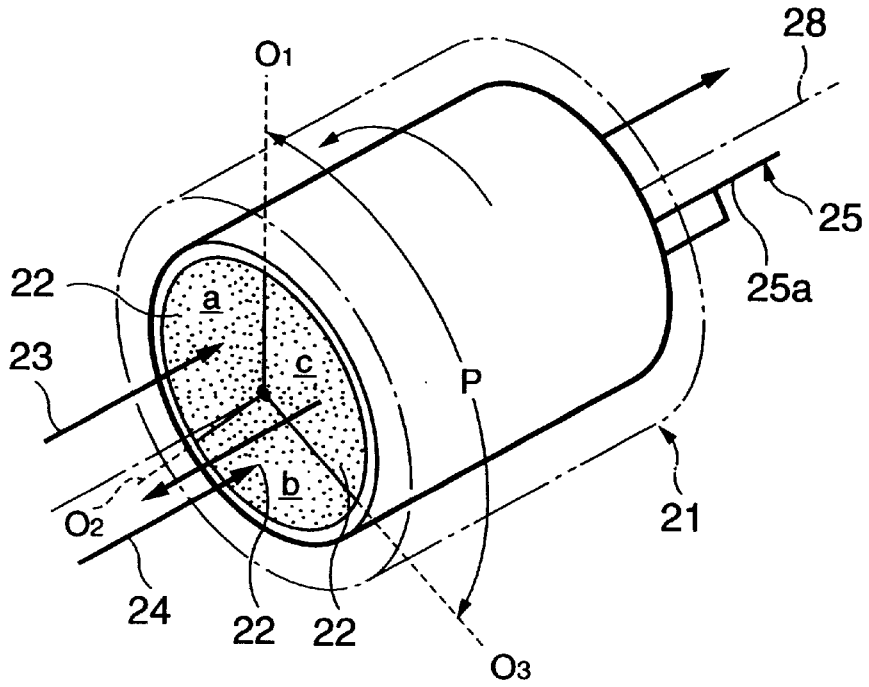
FIG. 16 shows a third embodiment of the regenerative heat exchanger according to the invention.

FIG. 16 shows an embodiment of the heat exchanger body 21 in which the purging gas path 24 branches from the incoming path 25*a* of the circulating gas path 25. With this configuration, the circulating gas can be used also as the purging gas. While simplifying the purging gas path this leads to an overall reduction in cost for the device.

Figure 17:
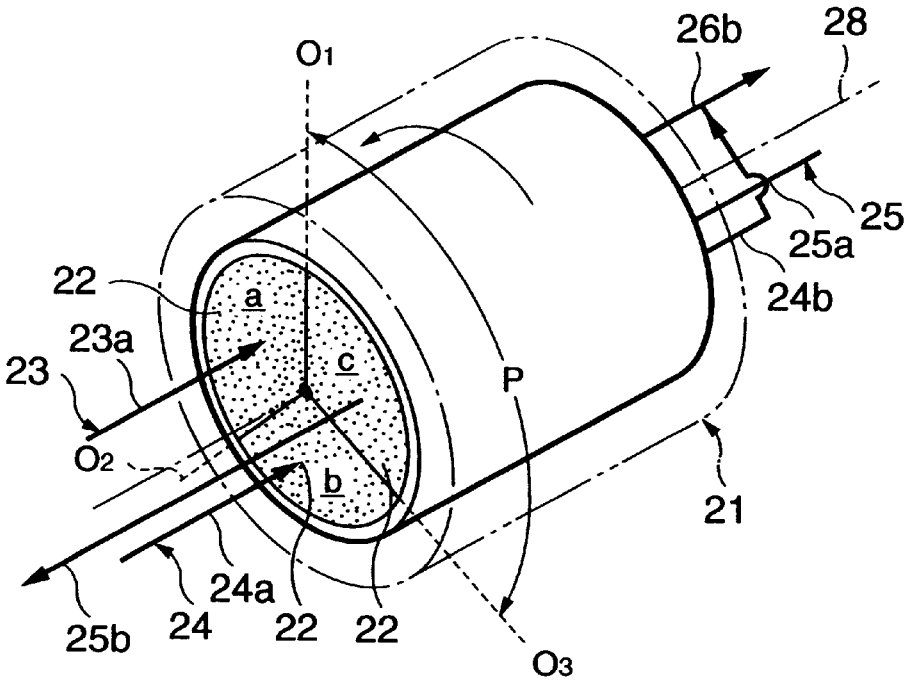
FIG. 17 shows a fourth embodiment of the regenerative heat exchanger according to the fifth embodiment of the invention.

FIG. 17 shows an embodiment of the heat exchanger body 21 in which the incoming path 24*a* of the purging gas path 24 is connected to an outgoing path 25*b* of the circulating gas path 25 and the outgoing path 24*b* is connected to the outgoing path 23*b* of the exhaust gas passing section. In this constitution, no outgoing path is required for the purging gas path 24.

Figure 18:
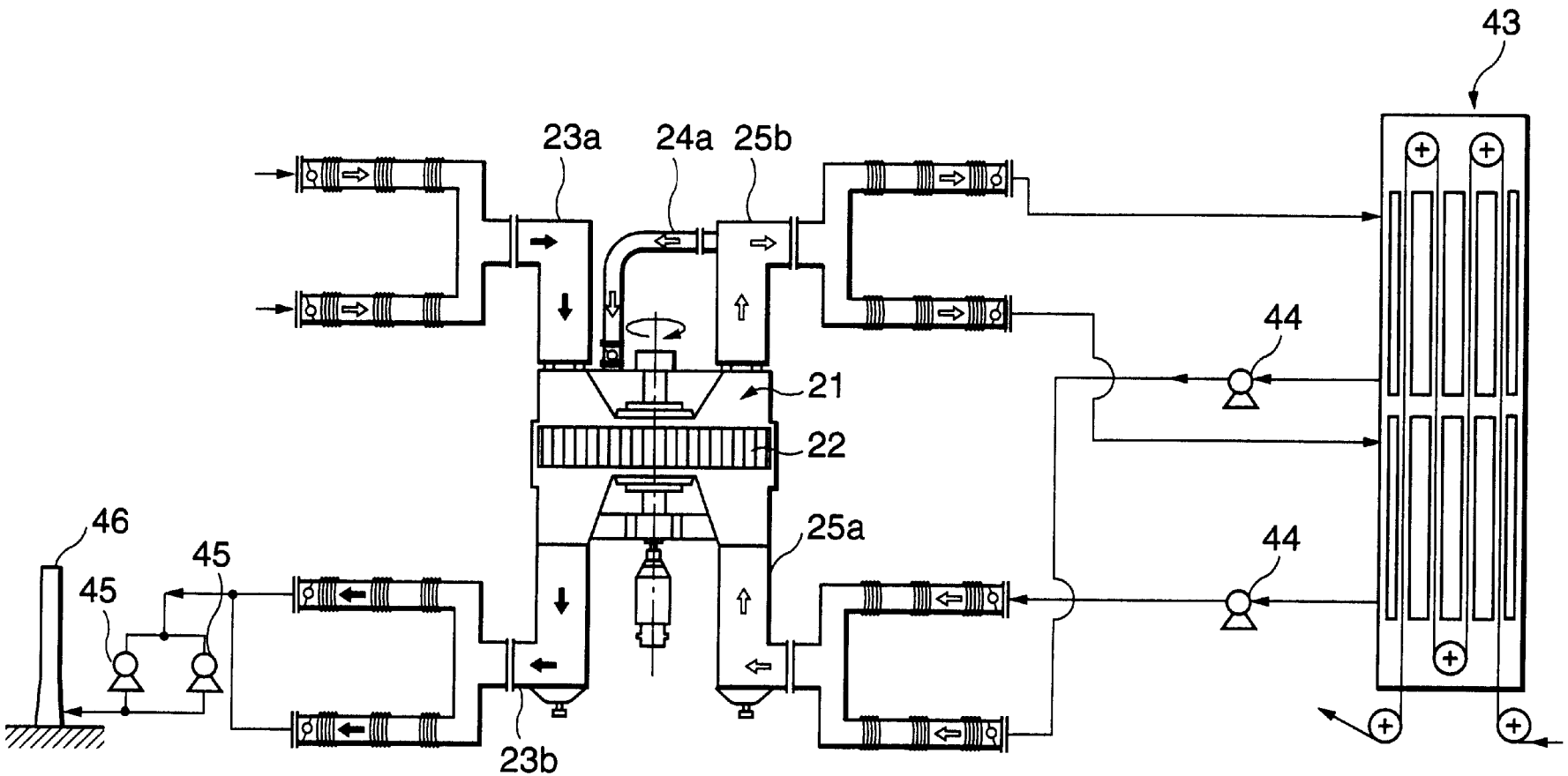
FIG. 18 is a schematic representation of FIG. 17 including the preheating section.
Figure 19:
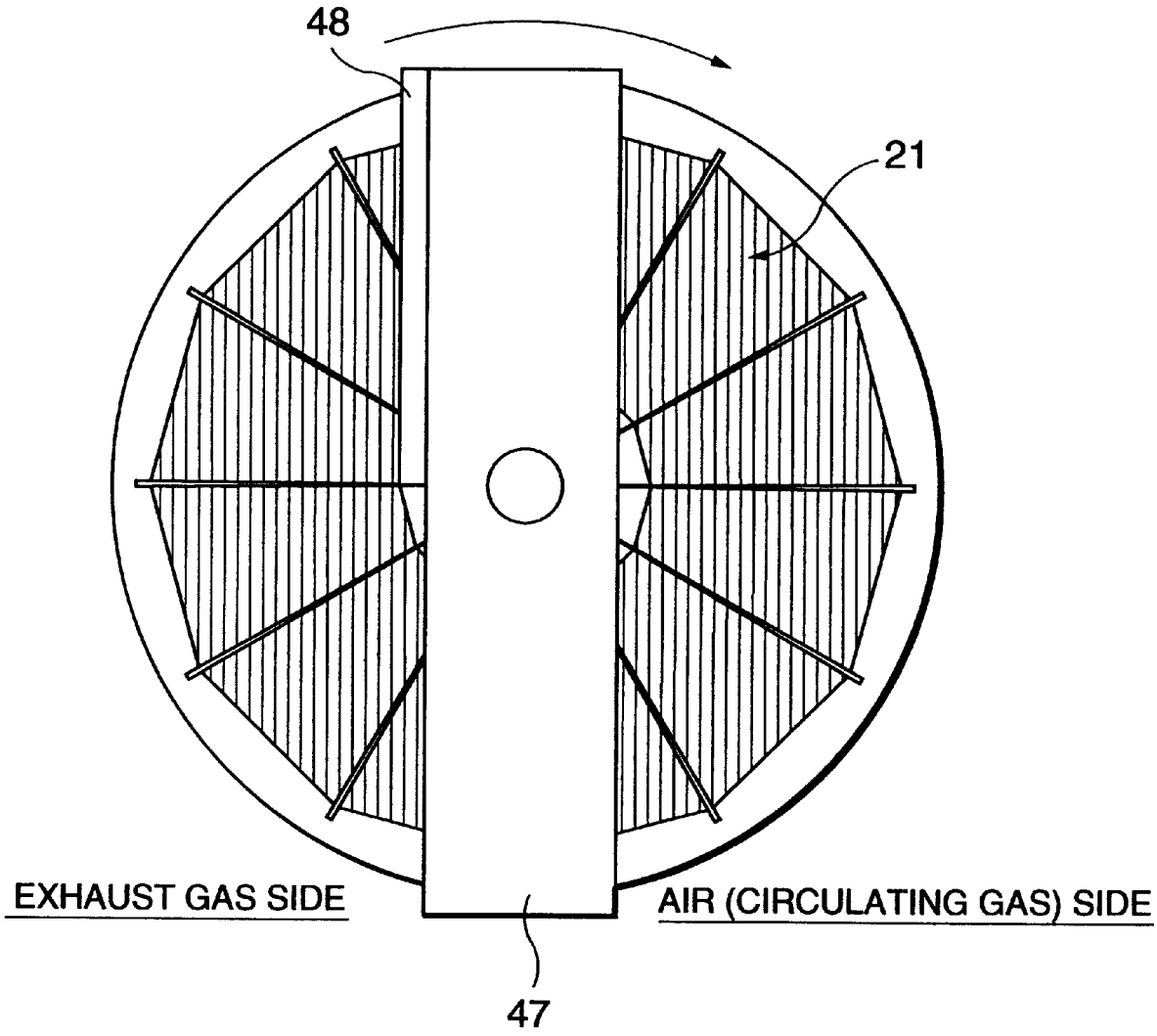
FIG. 19 is a plan view of the heat exchanger according to the invention.

FIGS. 18 and 19 show the heat exchanger body 21 of FIG. 17 in greater detail. Specifically, FIG. 18 shows in detail the device including the preheating section 43 of the annealing furnace, the circulating air fans 44, the exhaust fans 45 and a funnel 46. FIG. 19 is a plan view of the heat exchanger according to the third embodiment of the heat exchanger body 21 of this invention, as shown in FIG. 17. In FIG. 19, numeral 47 denotes a sector plate which rotatably holds the heat exchanger body 21. Adjacent to the sector plate 47 an inlet 48 for purging gas can be provided.

FIGS. 11 through 14 show a heat exchanger for the annealing furnace according to the fifth embodiment of the invention. In FIGS. 11 through 14, in the heat exchanger casing 29, the regenerator 22 ($Al_2O_3$ or other balls) is fixed and held. On the upper and lower faces of the regenerator 22, plate members are disposed. The plate members have numerous holes therein to facilitate gas distribution.

A rotation axis 28 which holds the regenerator 22 is supported by bearings on the upper and lower faces of the casing 29. The circulating gas path 25 is a duct which has an open end covering almost half of the lower periphery of the regenerator 22, while the heating section combustion exhaust gas path 23 is a duct which has an open end covering almost half the upper periphery of the regenerator 22. Paths 25 and 23 partially constitute the regenerator 22.

A chamber 31 hermetically surrounds the lower open end of the circulating gas distribution duct 41 and is connected to the circulating gas supply path 25. A chamber 32 hermetically surrounds the upper open end of the heating section combustion exhaust gas distribution duct 42 and is connected to the heating section combustion exhaust gas supply path 23.

A drive mechanism 33 is formed by a motor 33*a*, a speed reducer 33*b* and a gear 33*c*. The gear 33*c* of the drive mechanism 33 engages a rack (not shown) which is provided on a lower-end outer periphery of the circulating gas distribution duct 41. Similarly, a drive mechanism 34 is formed of a motor 34*a*, a speed reducer 34*b* and a gear 34*c*. The gear 34*c* of the drive mechanism 34 is engages a rack (not shown) which is provided on an upper-end outer periphery of the heating section combustion exhaust gas distribution duct 42. By operating the drive mechanisms 33 and 34, the ducts 41 and 42 are rotated in the direction illustrated by arrows in FIG. 11.

A partition 35 forms a local region $d_1$ (shown in FIG. 14) in the circulating gas distribution duct 41, while a partition 36 forms a local region $d_2$ (shown in FIG. 13) in the heating section combustion exhaust gas distribution duct 42. The purging gas path 24 is formed in such a manner that the purging gas passes from the local region $d_1$ via the regenerator 22 to the local region $d_2$. In this embodiment, a portion of the circulating gas is used as the purging gas. The heating section combustion exhaust gas whose sensible heat is applied to the regenerator 22, is exhausted from a heating section exhaust gas outlet 37. The heating section exhaust gas enters an inlet 38. The circulating gas which has passed the regenerator 22, thus raising its temperature, is exhausted from a circulating air outlet 39 which is connected to the preheating section of the annealing furnace or the like. The circulating gas enters an inlet 40.

In the regenerative heat exchanger having the above-described structure, the sensible heat of the heating section exhaust gas is recovered as follows. First, the regenerator 22 is divided into a first portion 22*a*, a second portion 22*b*, and a third portion 22*c*. The first portion 22*a* is opposed to the heating section combustion exhaust gas distribution duct 42. The second portion 22*b* is opposed to the purging gas path 24. The third portion 22*c* is opposed to the circulating gas distribution duct 41. Exhaust gas passes from the inlet 38 into the heating section combustion exhaust gas distribution duct 42, the heat of the first portion 22*a*, the heating section exhaust gas is stored in the regenerator 22, and the heating section exhaust gas is exhausted from the exhaust gas outlet 37. In this case, as the heating section combustion exhaust gas distribution duct 42 rotates, the region changes at a predetermined speed with an elapse of time.

Simultaneously, in the second portion 22*b*, the purging gas passes through the regions d1 and d2. The heating section exhaust gas residual in the regenerator 22, and the debris in the gas sticking to the regenerator 22, are removed. The purging gas is blown in because if the circulating gas passed through the regenerator is raised in temperature by the exhaust gas, then blown directly to the metal strip in the preheating section, debris or the like included in the exhaust gas could stick to the strip deteriorating the surface quality of the product. Also simultaneously, the third portion 22*c* circulating gas flows in, its temperature is increased by the regenerator 22, and the circulating gas is supplied via the outlet 39 to the preheating section of the annealing furnace or the like. As described above, storing the heat from the heating section exhaust gas, and the purging and raising of the circulating gas temperature are repeated in a cycle as long as the circulating gas distribution duct 41 and the heating section combustion exhaust gas distribution duct 42 are rotated in the directions indicated by the arrows in FIG. 11, thereby allowing the heat of 200 exhaust gas to be efficiently recovered.

In this type of heat exchanger, in the same manner as the third embodiment, to prevent the heating section exhaust gas from flowing into the preheating section circulating air, a gas pressure is set in such a manner that:

$$P_e < P_p \leqq P_c$$

where:

$P_e$ is the pressure of the heating section exhaust pipe;

$P_p$ is the pressure of the purging gas; and $P_c$ is the pressure of the circulating gas.

Even if the circulating gas is used as the purging gas, the other sections are not largely affected. However, if the difference in pressure from the heating section exhaust gas is excessively large, the supply efficiency of circulating gas is dropped. To prevent the supply efficiency from greatly reducing, the differential pressure is preferably set in a range of 4,900 to 7,000 Pa.

Figure 13:
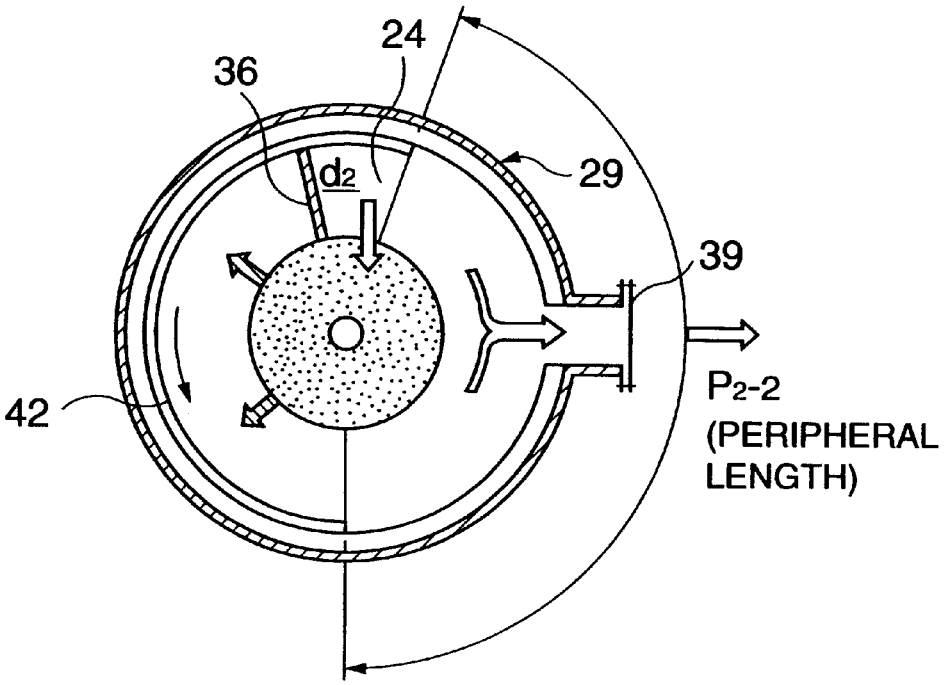
FIG. 13 is a second sectional view of the regenerative heat exchange shown in FIG. 11.
Figure 14:
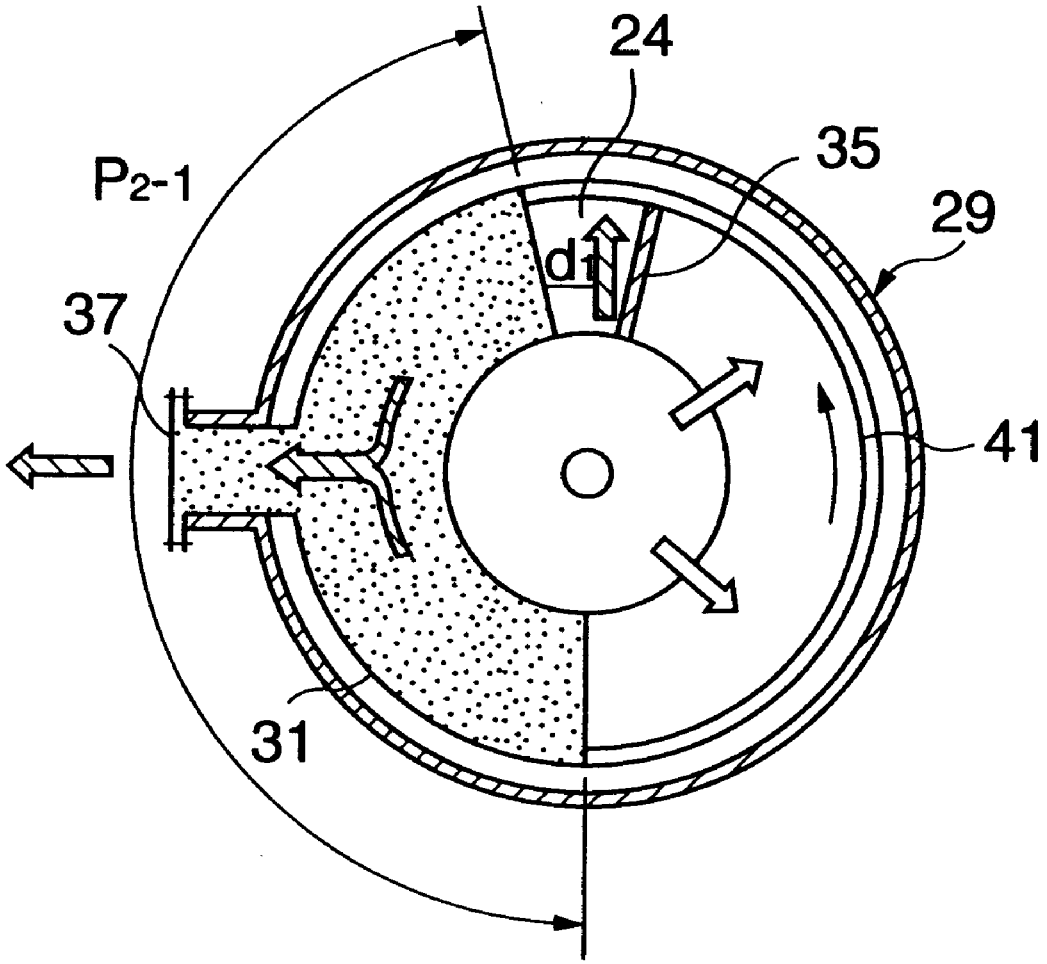
FIG. 14 is a third sectional view of the regenerative heat exchange shown in FIG. 11.

When the cycle pitch of the heating section combustion exhaust gas distribution duct 42 is $L_1$, the cycle pitch of the circulating gas distribution duct 41 is $L_2$, the peripheral length shown in FIGS. 13 and 14 is $P_2(P_{2\text{-}1}=P_{2\text{-}2})$ in meters (m), and the rotational speed is $V_2$ in meters per second (m/sec). The cycle pitch $t_2$ is then:

$$t_2 = L_2/V_2$$

Therefore, by changing the rotational speed, the pitch can be adjusted. In the present invention, the duct rotational speed is set to about 0.4 to 4 rpm. The duct can be continuously rotated by an electric motor or non-continuously rotated by using a cylinder and rod, however. The method of rotation is not especially restricted.

Figure 15:
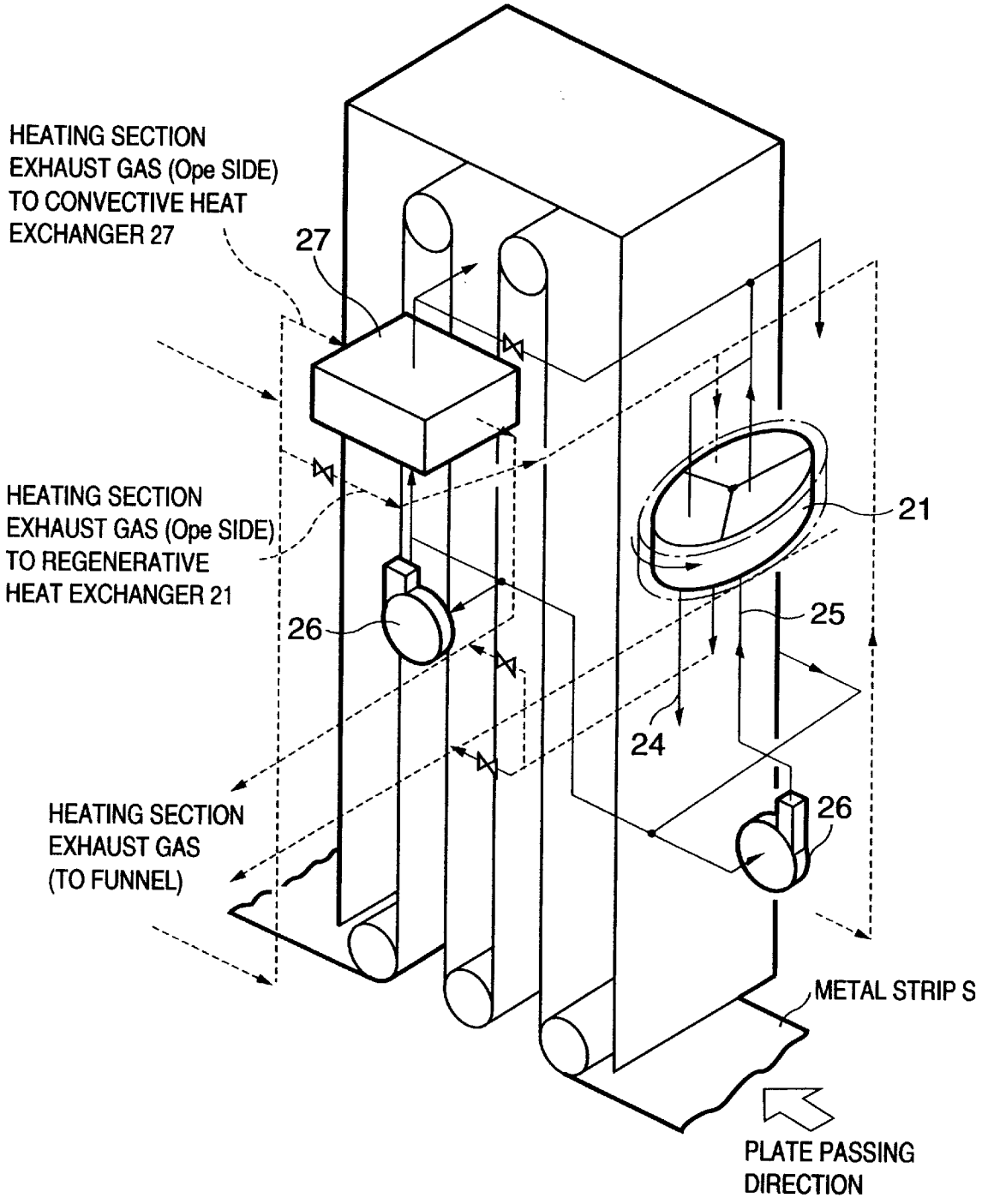
FIG. 15 shows the fifth embodiment of the regenerative heat exchange installed in a prior art convective heat exchanger.

FIG. 15 schematically shows an embodiment in which the heat exchanger body 21 is incorporated into the preheating section 100 of the continuous annealing furnace according to the fifth embodiment of the invention. In FIG. 15, a hot air circulating fan 26 for circulating gas and a conventional convective heat exchanger 27 are incorporated into the preheating section 100. When the circulating gas is used as the purging gas, its supply path is not especially required. However, if argon (Ar) gas or the like is used separately, a separate path can be provided, as shown in FIG. 15. Alternatively, plural heat exchangers, as previously disclosed, could be arranged in parallel. In this case, all the heat exchangers, including the conventional convective heat exchanger, could be used. In this case, at least one of the heat exchangers would be on standby, and can be used as a spare heat exchanger.

The regenerator 22 is preferably formed of $Al_2O_3$, SUS310 or SUS316 according to Japanese Industrial Standards, or another material superior in heat resistance and corrosion resistance. The regenerator 22 can be formed in a ball, a honeycomb structure body or the like. However, to ensure heating section exhaust gas does not flow into the circulating gas, a regenerator having a honeycomb structure body having directivity is preferably used.

In the device shown in FIG. 15, a cold rolled steel plate 0.5 to 2.3 mm thick and 700 to 1850 mm wide is continuously annealed. To comparatively illustrate the advantages of the present invention the following variables are realized: the heat recovery ratio from a heating section exhaust gas (raised heat of preheating section circulating air/exhaust gas sensible heat), the steel strip temperature on the heating section incoming side, the fuel consumption rate, the furnace temperature in the heating section, the burner combustion load in the heating section, the radiant tube life, the number of switching valves, and the device cost in relation to the conventional convective heat exchanger.

Treatment Condition:

heating section exhaust gas flow rate: 35310 $Nm^3$/hr fluid: M gas combustion exhaust gas heat exchanger incoming-side temperature: 627° C.

heat exchanger outgoing-side temperature: 403° C.

heat exchanger incoming-side pressure: −3,240 Pa preheating section circulating gas flow rate: 66365 $Nm^3$/hr fluid: air heat exchanger incoming-side temperature: 360° C.

heat exchanger outgoing-side temperature: 575° C.

heat exchanger incoming-side pressure: +2,350 Pa purging gas circulating gas heat exchanger specification embodiment: rotary regenerative heat exchanger (exchanger quantity 20,093MJ/hr)

comparative example: plate heat exchanger (exchanger quantity 5,860MJ/hr)

Regenerator: SUS 304 (honeycomb structure body)

TABLE 1

| Evaluation Index | Comparative example | Embodiment example |
|---|---|---|
| Exhaust gas recovery ratio % | 15 | 31 |
| Steel strip heating section incoming-side temperature ° C. | 120 | 210 |
| Fuel Consumption rate MJ/t-steel | 996.3 | 862.3 |
| Heating section furnace termperature ° C. | 941 | 927 |
| Burner combustion load MJ/hr × burner | 528.3 | 475.1 |
| Radiant tube lifetime years | 5.5 | 12.3 |
| Number of switching valves | 20 | 8 |
| Device cost | 100 (INDEX) | 95 |

As clearly seen from Table 1, the regenerative heat exchanger according to the invention is negligibly adversely affected by the combustion exhaust gas. As compared with the conventional convective heat exchanger, the exhaust gas recovery ratio can be improved by 15% or more (as compared with the conventional regenerative heat exchanger, about 15%), and the heating section incoming-side temperature of the steel strip can be raised by about 90° C. It can further be seen that all the remainder of the variables tend to be improved.

Figure 20:
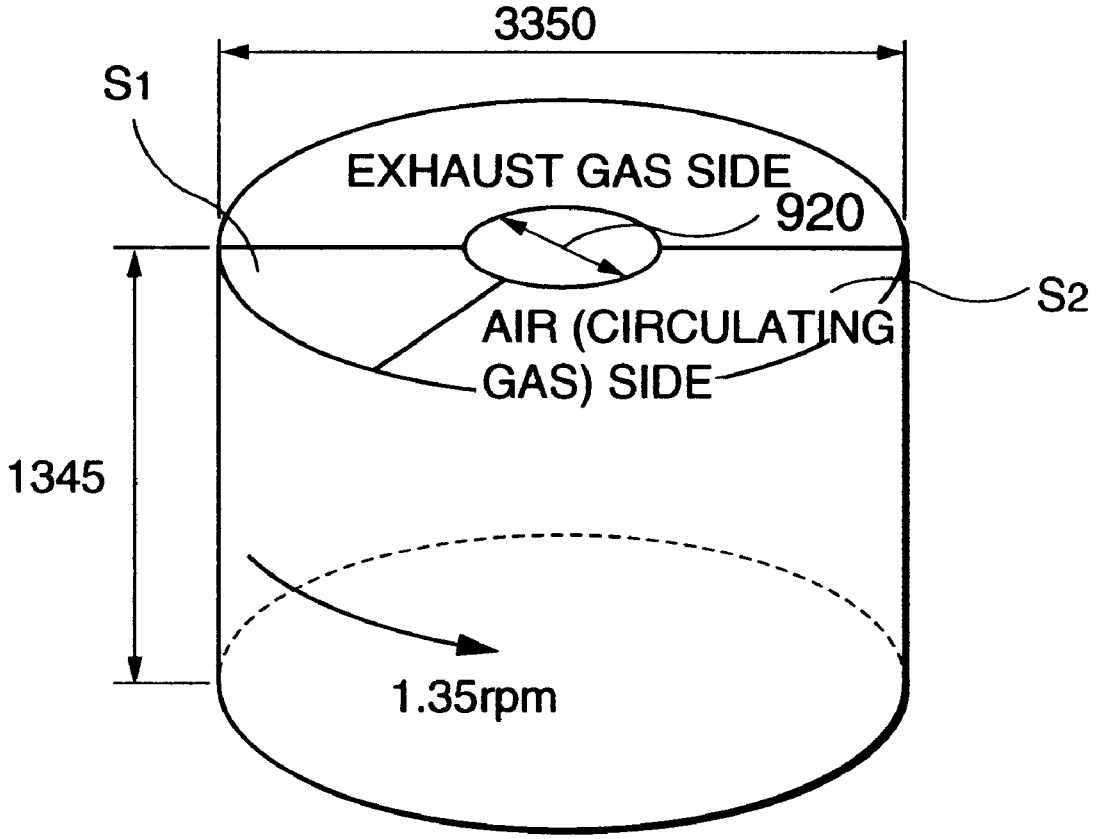
FIG. 20 is a schematic representation showing the size of the heat exchanger.

When a rotary regenerator as shown in FIG. 20 is operated under the condition that the average air flow rate $Q_a$ in a regenerator is 47 $m^3$/sec and the rotational speed of the regenerator is 1.35 rpm, then the air piping approach volume of the regenerator, the approach volume in the circulating gas passing section, $V_1$ is:

$$V_1=1.345'p\{(3.35/2)^2-(0.92/2)^2\}'1/2p'(2p'1.35/60)=2.47'10^{-1}[m^3/sec]$$

The ratio of the sectional area $S_1$ of the purging gas passing section and the sectional area $S_2$ of the circulating gas passing section, including a safety factor of 50%, is:

$$S_1/S_2=\{1/(47/0.247)-1\}'1.5=0.8\%$$

According to the present invention, the number of pipes and valves associated the heat exchanger is minimized, and the device itself can be made more compact. Further, the heat loss of the combustion exhaust gas can be recovered efficiently. Also, by efficiently recovering the heat loss of the combustion exhaust gas, the temperature of the metal strip can be effectively raised in the preheating section. Therefore, the set temperature of the heating section can be set to the minimum temperature required for treating the steel plate. Since the invention can be applied to devices other than the heating furnace with the radiant tubes, the equipment cost can be saved while the consumption load of the burner can be advantageously reduced. For the radiant tube especially, its life can be remarkably prolonged, while changing the hoods on the outgoing or incoming side of the heat exchanger, the passing area of exhaust gas and air can be optionally regulated.

What is claim is:

1. A continuous heat treating furnace comprising:

a heating device having a plurality of burners that heat to a predetermined temperature a material by means of combustion of the burners;

a regenerative heat exchanger device that collects a sensible heat of a combustion exhaust gas from the plurality of burners, stores the sensible heat in a regenerator and supplies a first gas to the regenerator to recover the sensible heat to the first gas; and a preheating section that blows the first gas from the regenerative heat exchanger device to the material.

2. The continuous heat treating furnace of claim 1 wherein said burners are direct heating burners.

3. The continuous heat treating furnace of claim 1 further comprising:

a heating section provided with a plurality of radiant tubes to which the combustion exhaust gas of the burners is supplied for heating to a predetermined temperature the material with a radiant heat from the radiant tubes;

the regenerative heat exchanger collects and stores in the regenerator the sensible heat of the combustion exhaust gas after the radiant tubes are heated by the combustion exhaust gas of the burners in the heating section and supplies the first gas to the regenerator to recover the sensible heat to the first gas; and the preheating section blows the first gas from the regenerative heat exchanger to the material on the incoming side of said heating section.

4. The continuous heat treating furnace of claim 1 wherein the regenerative heat exchanger device comprises at least three regenerative heat exchangers, the at least three regenerative heat exchangers provided with path switches for switching the combustion exhaust gas and the first gas to be supplied to the regenerator; and a controller that sequentially controls the path switches of the regenerative heat exchangers in such a manner that at least one regenerative heat exchanger blows to the material the first gas with the sensible heat stored in the regenerator while the remaining at least one regenerative heat exchanger stores in the regenerator the sensible heat of the combustion exhaust gas.

5. The continuous heat treating furnace of claim 4 wherein:

each of said regenerative heat exchangers is provided with a path switch that supplies the combustion exhaust gas to the regenerator, a path switch that supplies the first gas to the regenerator, a path switch that exhausts the combustion exhaust gas from the regenerator to the outside of the preheating section, a path switch that supplies the first gas from the regenerator into the preheating section; and a path switch that supplies said first gas from the regenerator into the preheating section for purging said heat exchanger.

6. The continuous heat treating furnace of claim 5 wherein:

a flow rate in each of the regenerative heat exchangers that purges said heat exchanger with the first gas is set less than the flow rate that supplies the first gas into the preheating section.

7. The continuous heat treating furnace of claim 5 wherein the regenerator is constituted of three sections comprising:

a heating section combustion exhaust gas path that passes a heating section combustion exhaust gas to apply the sensible heat of the heating section combustion exhaust gas of an annealing furnace to the regenerator, a purging gas path that passes the purging gas to remove exhaust gas residual in a sensible heat recovery path when the temperature of the circulating gas is increased through the regenerator, and a circulating gas path that heats a circulating gas, wherein the regenerator is continuously or intermittently rotated in such a manner that the sections of the regenerator change roles with rotation from the heating section combustion exhaust gas path, to the purging gas path to the circulating gas path sequentially and repeatedly.

8. The continuous heat treating furnace of claim 7 wherein:

the circulating gas is used as the purging gas, the circulating gas and the purging gas are flown in the same direction, and the circulating gas and the heating section combustion exhaust gas are flown in opposite directions.

9. The continuous heat treating furnace of claim 7, wherein:

the regenerator is fixed while a circulating gas distribution duct and a heating section combustion exhaust gas distribution duct are rotated.

10. The continuous heat treating furnace of claim 7 wherein:

a circulating gas distribution duct and a heating section combustion exhaust gas distribution duct are fixed while the regenerator is rotated.

11. The continuous heat treating furnace of claim 7 wherein:

the regenerator is a refractory mainly constituted of alumina.

12. The continuous heat treating furnace of claim 7 wherein:

the regenerator is formed of stainless steel.

13. The continuous heat treating furnace of claim 7 wherein:

the purging gas is passed from a region of the circulating gas distribution duct via the regenerator to a region of the heating section combustion exhaust gas distribution duct.

14. The continuous heat treating furnace of claim 7 wherein:

a relationship between a sectional area of a purging gas passing section and a sectional area of a circulating gas passing section satisfies a following expression:

$$S_1/S_2 \geqq 1/[(Q_a/V_1)-1],$$

wherein:

$S_1$ is the sectional area ($m^2$) of the purging gas passing section;

$S_2$ is the sectional area ($m^2$)of the circulating gas passing section,

Qa is an average flow rate ($m^3/S$) of air passing through the regenerator; and $V_1$ is an approach volume ($m^3/S$) of the circulating gas passing section.

15. The continuous heat treating furnace of claim 7 wherein:

a static pressure of the circulating gas is higher than a static pressure of the exhaust gas.

16. The continuous heat treating furnace of claim 7 wherein:

an incoming path of the purging gas passing section is branched from an incoming path of the circulating gas passing section.

17. The continuous heat treating furnace of claim 7 wherein:

an incoming path of the purging gas passing section is connected to an outgoing path of the circulating gas passing section; and an outgoing path of the purging gas passing section is connected to an outgoing path of the exhaust gas passing section.

18. A metal strip annealing heat exchanger which raises through a regenerator a temperature of a circulating gas for use in preheating a material in a preheating section of an annealing furnace wherein:

the regenerator is constituted of three sections:

a heating section combustion exhaust gas path that passes a heating section combustion exhaust gas to apply to the regenerator a sensible heat of the heating section combustion exhaust gas of the annealing furnace, a purging gas path that passes a purging gas to remove debris sticking to a sensible heat recovery path when applying the sensible heat of the heating section combustion exhaust gas, and a circulating gas path that heats the circulating gas, wherein:

the regenerator is continuously or intermittently rotated in such a manner that the sections of the regenerator change roles with rotation from the heating section combustion exhaust gas path, then the purging gas path to the circulating gas path sequentially and repeatedly.

19. The continuous heat treating furnace of claim 6, wherein each of said heat exchangers is provided with a control means that follows a path switching procedure in such a manner that after the path switch that supplies the combustion exhaust gas to the regenerator of the regenerative heat exchanger is closed, the path switch that purges the heat exchanger with said first gas is opened, while the path switch that purges said heat exchanger with said first gas is open, said path switch that exhausts said combustion exhaust gas is opened and the path switch that supplies the first gas is closed, and after the path switch for purging said heat exchanger with said first gas is closed, and the path switch that exhausts said combustion exhaust gas is closed, and the path switch that supplies said first gas is opened and the path switch that supplies said first gas to the regenerator of the heat exchanger is opened.

20. The continuous heat treating furnace of claim 4, wherein the three regenerative heat exchangers are formed into an integral equipment.

21. The continuous heat treating furnace of claim 4, wherein the first gas to which the sensible heat is recovered is the circulating gas.

* * * * *